US012222156B2

(12) United States Patent
Yoo et al.

(10) Patent No.: US 12,222,156 B2
(45) Date of Patent: Feb. 11, 2025

(54) REFRIGERATOR

(71) Applicant: LG ELECTRONICS INC., Seoul (KR)

(72) Inventors: Daehyun Yoo, Seoul (KR); Geonwoo Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 179 days.

(21) Appl. No.: 17/791,349

(22) PCT Filed: Jan. 7, 2020

(86) PCT No.: PCT/KR2020/000294
§ 371 (c)(1),
(2) Date: Jul. 7, 2022

(87) PCT Pub. No.: WO2021/141154
PCT Pub. Date: Jul. 15, 2021

(65) Prior Publication Data
US 2023/0349628 A1 Nov. 2, 2023

(51) Int. Cl.
*F25D 23/06* (2006.01)
*F25D 29/00* (2006.01)

(52) U.S. Cl.
CPC ..... *F25D 23/063* (2013.01); *F25D 23/067* (2013.01); *F25D 29/005* (2013.01); *F25D 2400/08* (2013.01); *F25D 2400/36* (2013.01)

(58) Field of Classification Search
CPC .... F25D 23/063; F25D 23/065; F25D 23/067; F25D 29/00; F25D 29/005; F25D 2400/08; F25D 2400/36; F25D 2400/361
See application file for complete search history.

(56) References Cited

U.S. PATENT DOCUMENTS 2,123,588 A * 7/1938 Luneke ..... F25D 23/065 220/326
2,311,540 A * 2/1943 Hastings ..... F25D 23/065 62/391

(Continued)

FOREIGN PATENT DOCUMENTS

CN 109373688 A * 2/2019 ..... F25D 23/02
EP 2169336 A2 * 3/2010 ..... F25D 23/063

(Continued)

OTHER PUBLICATIONS

Japanese Office action dated Apr. 18, 2023 issued in Application No. 2022-526697.

(Continued)

*Primary Examiner* — Andrew Roersma
(74) *Attorney, Agent, or Firm* — KED & ASSOCIATES, LLP

(57) ABSTRACT

A refrigerator according to this embodiment includes: a cabinet provided with a storage space and including a pair of side panels configured to define an outer appearance of a side surface; a cabinet cover disposed between the pair of side panels and configured to define an outer appearance of a top surface; a display unit disposed behind the cabinet cover and provided for user's manipulation; and a fixing unit which is fixed to the cabinet and disposed between the pair of side panels and to which the display unit is separably fixed, wherein the display unit is installed to be separated upward from the fixing unit.

16 Claims, 19 Drawing Sheets

(56) References Cited

U.S. PATENT DOCUMENTS

| | | | | |
|---|---|---|---|---|
| 2,628,388 | A * | 2/1953 | Poth | F25D 23/063 52/282.4 |
| 7,713,090 | B2 | 5/2010 | Kendall et al. | |
| 8,984,913 | B2 | 3/2015 | Park et al. | |
| 11,473,834 | B2 | 10/2022 | Park et al. | |
| 2009/0241588 | A1* | 10/2009 | Kitamura | F25D 23/067 29/890.035 |
| 2017/0159351 | A1* | 6/2017 | Kim | A47L 15/4265 |
| 2018/0187957 | A1* | 7/2018 | Jung | F25D 23/062 |
| 2018/0274826 | A1* | 9/2018 | Kim | F25B 21/04 |
| 2019/0280511 | A1 | 9/2019 | Park et al. | |
| 2019/0285355 | A1 | 9/2019 | Lee et al. | |
| 2022/0099358 | A1* | 3/2022 | Jung | F25D 23/063 |

FOREIGN PATENT DOCUMENTS

| | | | | |
|---|---|---|---|---|
| JP | 2017-133799 | | 8/2017 | |
| KR | 200336425 | Y1 * | 12/2003 | F25D 23/06 |
| KR | 10-2004-0003319 | A | 1/2004 | |
| KR | 10-2005-0100791 | | 10/2005 | |
| KR | 10-2006-0109162 | A | 10/2006 | |
| KR | 10-2017-0087640 | A | 7/2017 | |
| KR | 1020180106835 | A * | 10/2018 | F25D 23/02 |
| KR | 10-2019-0106494 | A | 9/2019 | |
| WO | WO-2013084685 | A1 * | 6/2013 | F25D 23/02 |
| WO | WO-2019019559 | A1 * | 1/2019 | F25D 11/00 |
| WO | WO 2019-177315 | A1 | 9/2019 | |

OTHER PUBLICATIONS

Extended European Search Report dated Aug. 7, 2023 issued in Application 20912164.9.

International Search Report (with English Translation) and Written Opinion dated Sep. 25, 2020 issued in Application No. PCT/KR2020/000294.

Korean Office Action dated Oct. 17, 2024 issued in Application No. 10-2022-7012896.

* cited by examiner

REFRIGERATOR

CROSS-REFERENCE TO RELATED PATENT APPLICATIONS

This application is a U.S. National Stage Application under 35 U.S.C. § 371 of

PCT Application No. PCT/KR2020/000294, filed Jan. 7, 2020, whose entire disclosures are hereby incorporated by reference.

TECHNICAL FIELD

The present invention relates to a refrigerator.

BACKGROUND ART

Generally, refrigerators are household appliances that are capable of store objects such as foods at a low temperature in a storage space provided in a cabinet. Since the storage space is surrounded by heat insulation wall, the inside of the storage space may be maintained at a temperature less than an external temperature.

The storage space may be classified into a refrigerating compartment or a freezing compartment according to a temperature range of the storage space. The food may be stored in the refrigerating compartment or the freezing compartment according to the type or condition of the food.

The refrigerator may be provided as a built-in type together with other electronic devices in the kitchen. In this case, a design in outer appearance of the refrigerator is performed in harmony with the furniture in the kitchen.

In addition, in recent years, installation positions of the refrigerator have been diversified, such as placing the refrigerator in the living room or the room instead of the kitchen according to various needs of the user.

As the installation positions of the refrigerator are diversified, the design of the outer appearance of the refrigerator is performed so that the outer appearance of the refrigerator is harmonized with the furniture in a space in which the refrigerator is installed.

For example, the outer appearance of the refrigerator may be designed to be made of wood to be harmonized with the furniture made of wood.

A refrigerator, in which a furniture door and a refrigerator door, which are made of wood, are screw-coupled to each other, is disclosed in Korean Patent Publication No. 10-2004-0003319, which is a prior art document.

However, the outer appearance made of the wood material may be damaged by moisture or the like when used for a long period of time and may require service such as replacement.

However, in the case of the prior art document, if it is required to perform a service such as the replacement or repair of the damaged furniture door, all the coupled screws have to be released, and thus, there is a problem in which a time taken for the service is long.

In addition, when a main body needs to be removed because the service of inner components is required, it takes a long time to disassemble the screw-coupled body, and thus, there is a problem in that it is difficult to be accessed to the inner components.

DISCLOSURE OF THE INVENTION

Technical Problem

An object of the present invention is to provide a refrigerator in which a cabinet cover made of a wood material is easily disassembled.

In addition, an object of the present invention is to provide a refrigerator in which a cabinet cover is easily disassembled without disassembling a rear panel disposed at a rear side from a cabinet.

In addition, an object of the present invention is to provide a refrigerator in which a display unit disposed at a rear side of a cabinet cover is easily separated from a cabinet.

In addition, an object of the present invention is to provide a refrigerator in which a time required for replacing and reassembling a cabinet cover is saved.

Technical Solution

A refrigerator according to the present invention for achieving the above objects includes: a cabinet provided with a storage space and including a pair of side panels configured to define an outer appearance of a side surface; a cabinet cover disposed between the pair of side panels and configured to define an outer appearance of a top surface; a display unit disposed behind the cabinet cover and provided for user's manipulation; and a fixing unit which is fixed to the cabinet and disposed between the pair of side panels and to which the display unit is separably fixed, wherein the display unit is installed to be separated upward from the fixing unit. Therefore, there may be an advantage in that it is easy to separate the display unit from the cabinet.

The cabinet cover may be detached backward in a state of being separated from the display unit. Therefore, as the display unit is easily separated, the cabinet cover may be easily and quickly separated from the cabinet.

The fixing unit may include a fixing protrusion, and a protrusion accommodation portion, in which the fixing protrusion is accommodated, may be provided in the display unit.

The fixing unit may further include a first body disposed to face the side panels, and the fixing protrusion protrudes from the first body.

The refrigerator may further include: an inner case configured to define the storage space; and a middle plate configured to cover an outer circumference of the inner case, wherein the fixing unit may further include a second body bent from the first body to face the middle plate.

The first body may be coupled to the side panels, and the second body may be coupled to the middle plate. Therefore, the fixing unit may facilitate the separation of the display unit and firmly couple the side panel and the middle plate to each other.

The first body may be coupled to the side panels, or the second body may be coupled to the middle plate.

The middle plate may include a rear plate disposed between the inner case and a rear panel defining a rear surface of the refrigerator, and the second body may be coupled to the rear plate.

The fixing protrusion may be provided in plurality, and the plurality of fixing protrusions may protrude from top and bottom surfaces of the first body.

The cabinet may further include: an inner case configured to define the storage space; and a middle plate configured to cover an outer circumference of the inner case, the fixing unit may include: a first body disposed to face the side panels; and a second body bent from the first body to face the middle plate, and the fixing protrusion may protrude from the second body.

The refrigerator may further include a rear panel configured to constitute the cabinet and define an outer appearance of a rear surface, wherein the display unit may further include a panel seating portion seated on the rear panel.

A bolt coupling hole through which a bolt is coupled to restrict vertical movement of the display unit may be defined in each of the panel seating portion and the rear panel.

The display unit may include: a display case above which a display panel is provided; and a display cover configured to cover the display panel and rotatably coupled to the display case, wherein the protrusion accommodation portion may be disposed on a side surface portion of the display case.

The protrusion accommodation portion may be recessed upward from a bottom surface of the side surface portion.

The fixing protrusion may have a thickness greater than that of the side surface portion.

The fixing protrusion may have the same height as the protrusion accommodation portion so that a bottom surface of the side surface portion is seated on a top surface of the first body.

A seating groove recessed downward from an upper end of the side surface portion may be defined in the display case, the display cover may include: a cover plate configured to cover an upper side of the display panel; and a pair of extension portions extending downward from both ends of the cover plate and rotatably coupled to the seating groove, and wherein the seating groove may be disposed behind the protrusion accommodation portion.

Advantageous Effects

According to the proposed invention, the cabinet cover made of wood may be easily separated to save the required time.

In addition, since it takes the short time to separate the cabinet cover, there may be the effect of increasing in service efficiency.

In addition, according to the present invention, since the cabinet cover and the display unit are separated without disassembling the rear panel from the main body (cabinet), there may be the effect that the reassembly process after the service is simplified.

In addition, according to the present invention, since the display unit is mounted to the cabinet by the fixing unit, the assembly process may be simplified in production process to improve the productivity.

In addition, according to the present invention, when the screw of the rear panel that fixes the display unit is released, the display unit may be lifted upward to be separated, and the cabinet cover may be easily separated backward.

In addition, since the replacement of the cabinet cover is performed simply and quickly, the user's reluctance to replace the cabinet cover may be reduced, and the user's desire to replace the cabinet cover may be easily satisfied.

MODE FOR CARRYING OUT THE INVENTION

Reference will now be made in detail to the embodiments of the present invention, examples of which are illustrated in the accompanying drawings.

Figure 1:
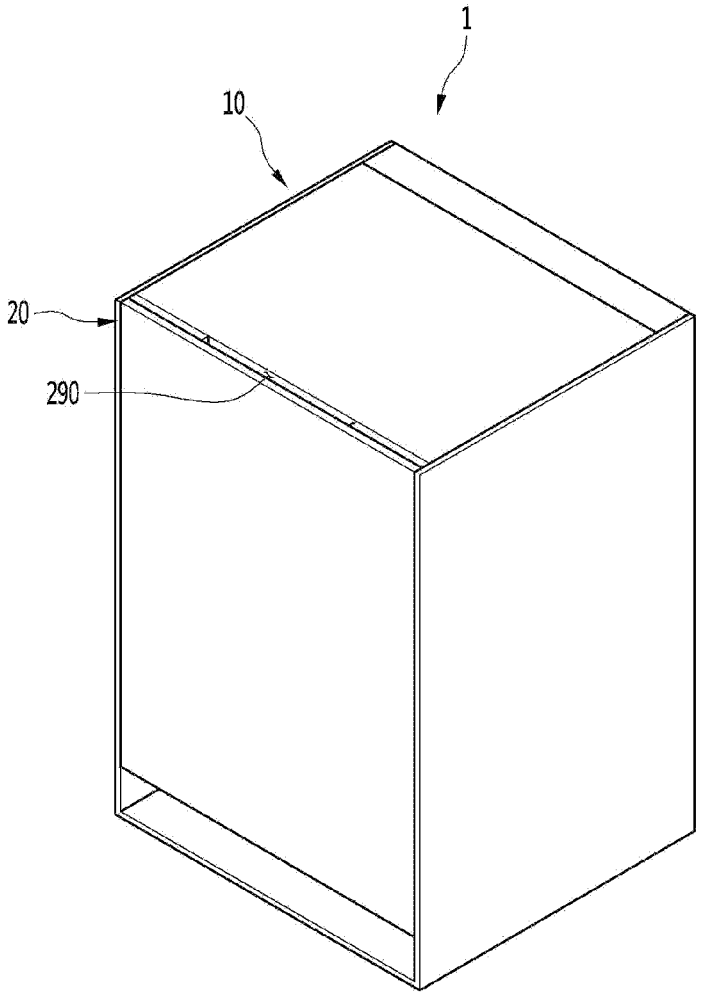
FIG. 1 is a perspective view of a refrigerator according to an embodiment of the present invention.
Figure 2:
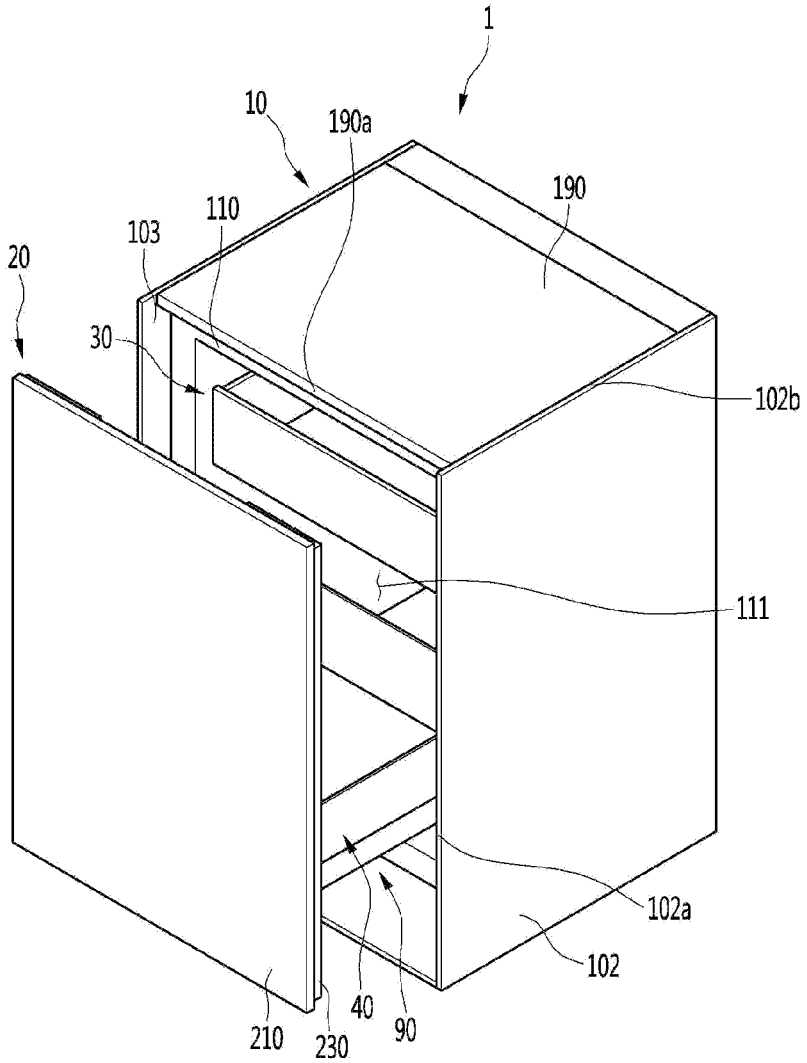
FIG. 2 is a perspective view illustrating a state in which a door is opened in FIG. 1.
Figure 3:
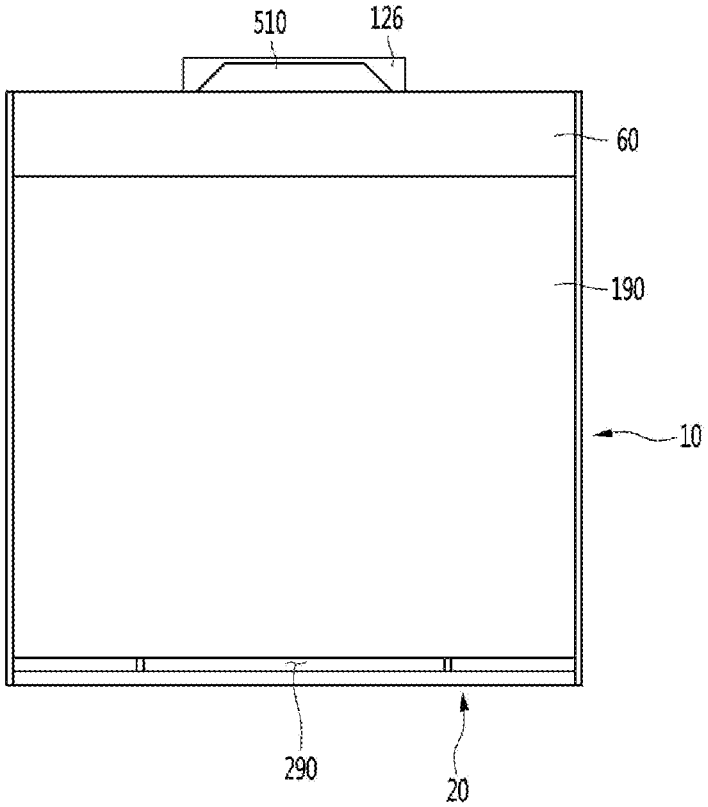
FIG. 3 is a plan view of the refrigerator of FIG. 1.

FIG. 1 is a perspective view of a refrigerator according to an embodiment of the present invention, FIG. 2 is a perspective view illustrating a state in which a door is opened in FIG. 1, and FIG. 3 is a plan view of the refrigerator of FIG. 1.

Referring to FIGS. 1 to 3, a refrigerator 1 according to an embodiment of the present invention may include a cabinet 10 provided with a storage space 111 and a door 20 connected to the cabinet 10 to open and close the storage space 111.

The cabinet 10 may include an inner case 110 defining the storage space 111 and an outer case 100 surrounding the inner case 110.

The outer case 100 may be made of a metal material. For example, the outer case 100 may be made of an aluminum (Al) material. The outer case 100 may be formed by being bent at least twice or bent. Alternatively, the outer case 100 may be formed by bonding a plurality of metal plates.

For example, the outer case 100 may include a pair of side panels 102 and 103.

The pair of side panels 102 and 103 may be arranged in a horizontal direction. In detail, the side panels 102 and 103 may include a right side panel 102 and a left side panel 103 with respect to a direction that is directed from the door 20 to the storage space 111.

Here, a direction that is directed from the door 20 to the storage space 111 may be defined as "a rear side", and a direction that is directed from the storage space 111 to the door 20 may be defined as a "front side". That is, the storage space 111 may be disposed at the rear side of the door 20.

The inner case 110 may be directly or indirectly fixed to the outer case 100 in a state of being disposed between the pair of side panels 102 and 103.

A front end 102*a* of each of the pair of side panels 102 and 103 may be disposed in front of the front surface of the inner case 110, rather than a front surface of the inner case 110.

A horizontal width of the door 20 may be equal to or less than a distance between the pair of side panels 102 and 103.

Thus, a space in which the door 20 is disposed may be defined between the pair of side panels 102 and 103.

For example, in a state in which the door 20 closes the storage space 111, the door 20 may be disposed between the pair of side panels 102 and 103.

Here, in a state in which the door 20 closes the storage space 111, the front surface of the door 20 may be disposed on the same plane as the front end of each of the side panels 102 and 103 so that the outer appearances of the door 20 and the cabinet 10 have a sense of unity.

That is, the front surface of the door 20 and the front end 102*a* of each of the side panels 102 and 103 may define the outer appearance of the front surface of the refrigerator 1.

The door 20 may be connected to, for example, the cabinet 10 by a rail assembly 90.

Thus, the door 20 may open and close the storage space 111 while moving in a forward and backward sliding manner in a state of being connected to the cabinet 10.

According to the present invention, even when the refrigerator 1 is disposed in a narrow space such as a kitchen, living room, or room, since the door 20 opens and closes the storage space 111 in the sliding manner, the door 20 may be opened without interfering with surrounding structures.

One side of the rail assembly 90 may be connected to the door 20, and the other side may be connected to the inner case 110.

The door 20 may include a front panel 210 made of a wood material and a door liner 230 coupled to a rear surface of the front panel 210.

The front panel 210 and the door liner 230 may be coupled to each other by, for example, a coupling member such as a screw. The front panel 210 and the door liner 230 may define a foaming space, and as a foaming liquid is filled in the foaming space, an insulating material may be provided between the front panel 210 and the door liner 230.

In order to open the door 20, the door 20 may define a space 290 for a handle into which a user's hand is inserted so that the user holds the door 20.

The space 290 for the handle may be defined, for example, as a portion of an upper portion of the door liner 230 is recessed downward.

The space 290 for the handle may be disposed between the front panel 210 and the cabinet 10 in a state in which the door 20 closes the storage space 111. Thus, the user may open the door 20 by pulling the door 20 after inserting the hand into the space 290 for the handle in the state in which the door 20 closes the storage space 111.

According to the present invention, since a structure such as the handle does not protrude to the outside in the state in which the door 20 is closed, the aesthetics of the refrigerator 1 may be improved.

A height of the refrigerator 1 is not limited, but may be less than that of a general adult. As a capacity of the refrigerator 1 decreases, the height of the refrigerator 1 may decrease.

As in the present invention, when the space 290 for the handle exists above the door 20, even if the height of the refrigerator 1 decreases, the user may easily open the door 20 in a standing or sit state.

The upper end 102*b* of each of the pair of side panels 102 and 103 may be disposed higher than an upper end of the inner case 110.

Thus, a space may be defined above the inner case 110, and a cabinet cover 190 may be disposed in the space. The cabinet cover 190 may define an outer appearance of a top surface of the cabinet 10. That is, the cabinet cover 190 defines the outer appearance of the top surface of the refrigerator 1.

The cabinet cover 190 may be fixed to the middle plate 150 surrounding the inner case 110.

In a state in which the cabinet cover 190 covers the inner case 110, the cabinet cover 190 may be disposed between the pair of side panels 102 and 103.

A top surface of the cabinet cover 190 may be disposed on the same plane or at the same height as the upper end 102*b* of each of the side panels 102 and 103 so that the outer appearances of the cabinet cover 190 and the cabinet 10 have a sense of unity.

The cabinet cover 190 may be made of, for example, a wood material.

According to the present invention, since each of the front panel 210 and the cabinet cover 190 of the door 20 is made of the wood material, in the state in which the door 20 is closed, there is an advantage in that there is a uniformity in material between the door 20 and the cabinet cover 190 to improve aesthetics.

Furthermore, when the height of the refrigerator 1 is low, the user may visually check the cabinet cover 190. Thus, since the cabinet cover 190 is made of the wood material, there may be an advantage of forming a sense of unity with surrounding furniture in which the refrigerator 1 is disposed as well as providing basic aesthetic feeling.

The refrigerator 1 of the present invention may be used, for example, as a side table refrigerator.

The side table refrigerator may serve as a side table in addition to a function of storing food. Unlike the general refrigerator that is often provided in the kitchen, the side table refrigerator may be used next to the bed in the bedroom. According to the present invention, since each of the cabinet cover 190 and the front panel 210 is made of the wood material, even if the refrigerator 1 is disposed in the bedroom, it may be harmonized with the surrounding furniture.

For the convenience of the user, a height of the side table refrigerator may be preferably similar to that of the bed, for example, and may be formed to have a height less than that of the general refrigerator and to be compact.

In addition, as the refrigerator 1 is used as the side table refrigerator, the user may place various objects on the cabinet cover 190, and in such a situation, the cabinet cover 190 may be damaged.

As an example, a case in which a liquid or the like is spilled on the cabinet cover 190, or an object having a sharp surface collides with the cabinet cover 190 may occur.

When the cabinet cover 190 is damaged, it may be necessary to replace the cabinet cover 190 in the refrigerator 1. According to the fixing structure of the present invention, which will be described later, since it is possible to provide a service to easily replace the cabinet cover 190, user satisfaction and service satisfaction may be improved.

The front surface 190*a* of the cabinet cover 190 may be disposed in front of the front surface of the inner case 110. Thus, in the state in which the door 20 closes the storage space 111, the cabinet cover 190 may cover a portion of the door liner 230 from the upper side.

The refrigerator 1 may further include one or more drawer assemblies 30 and 40 accommodated in the storage space 111. A plurality of drawer assemblies 30 and 40 may be provided in the storage space 111 in order to improve efficiency of the storage space.

Some of the plurality of drawer assemblies 30 and 40 may exist in a fixed position in the storage space 111 or may be connected to a rail and slidably disposed by the rail.

Alternatively, some of the plurality of drawer assemblies 30 and 40 may be connected to the door 20 so as to be slidably inserted and withdrawn together with the door 20.

Alternatively, some of the plurality of drawer assemblies 30 and 40 may be configured to be slidably withdrawn together with the door 20 at an initial stage of opening during the process of opening the door 20 and also to be stopped at a position that is withdrawn by a predetermined distance.

Hereinafter, the structure of the cabinet 10 will be described in detail.

In this case, the components constituting the cabinet 10 will be described in detail based on the process of assembling the cabinet 10.

Figure 4:
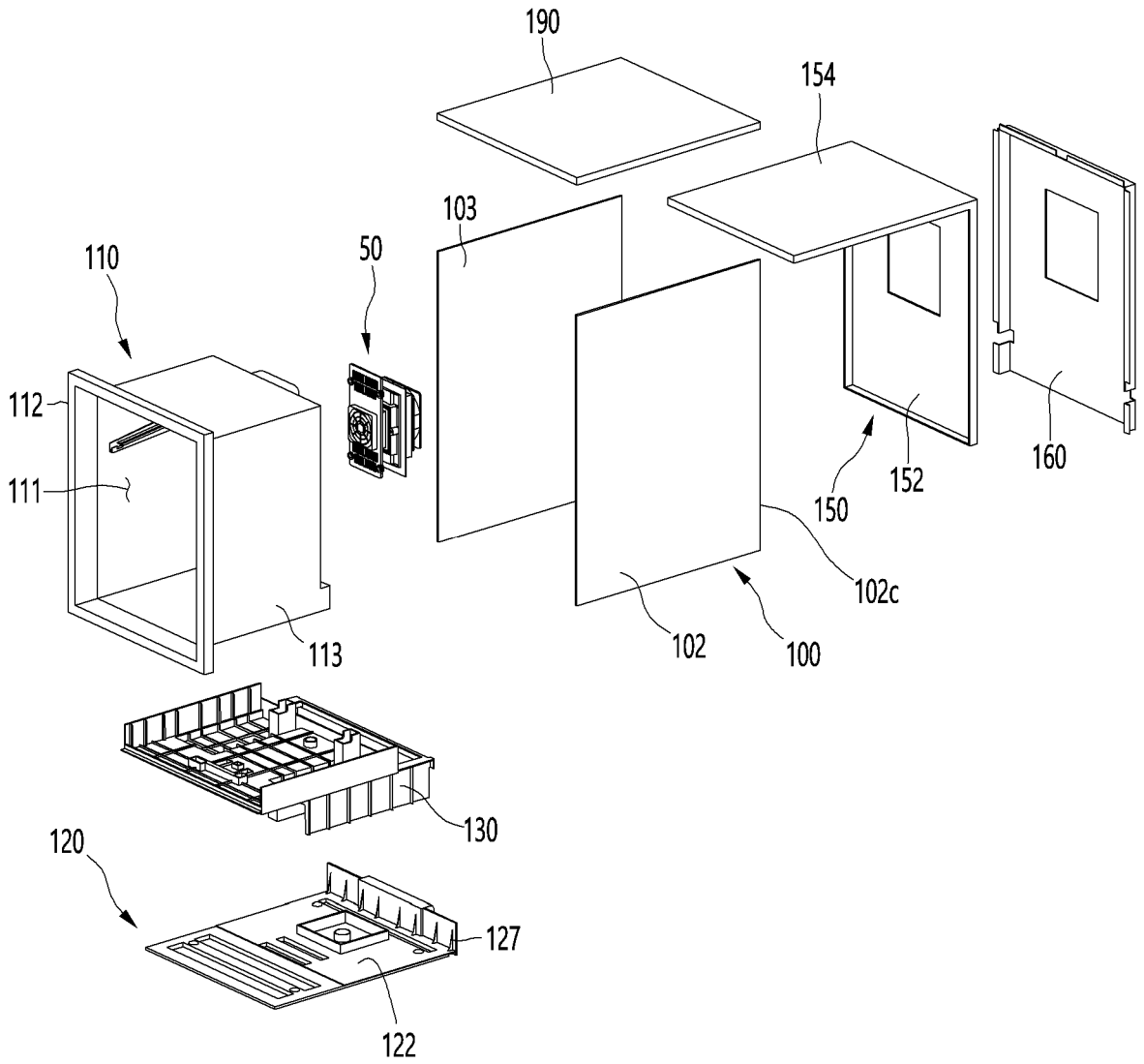
FIG. 4 is an exploded perspective view of a cabinet according to an embodiment of the present invention.
Figure 5:
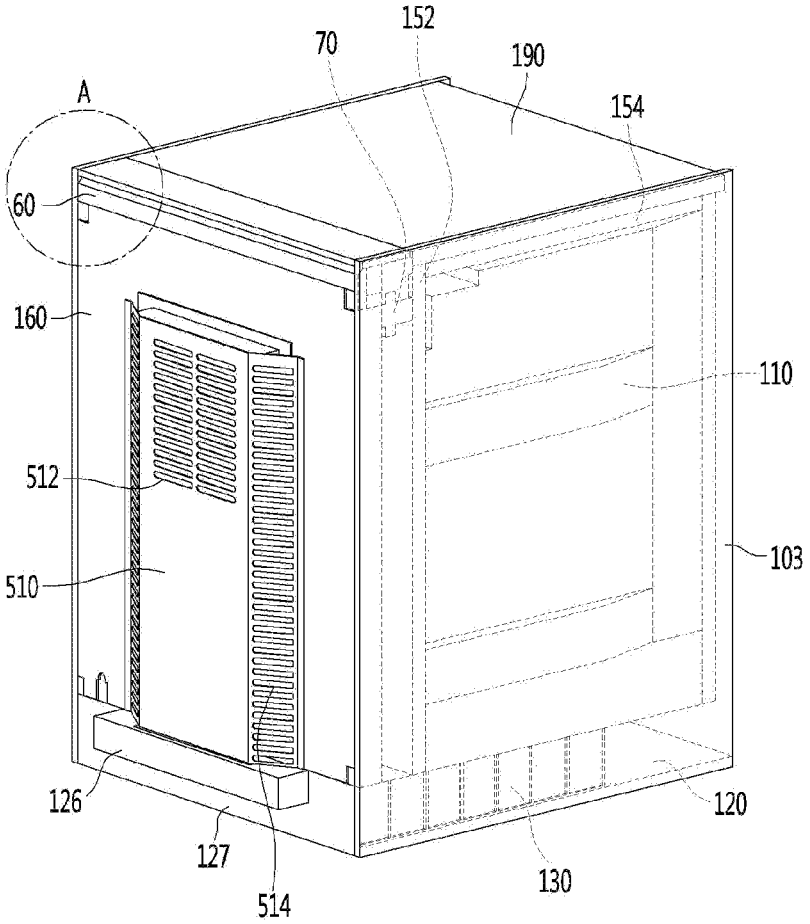
FIG. 5 is a rear perspective view of the refrigerator according to an embodiment of the present invention.
Figure 6:
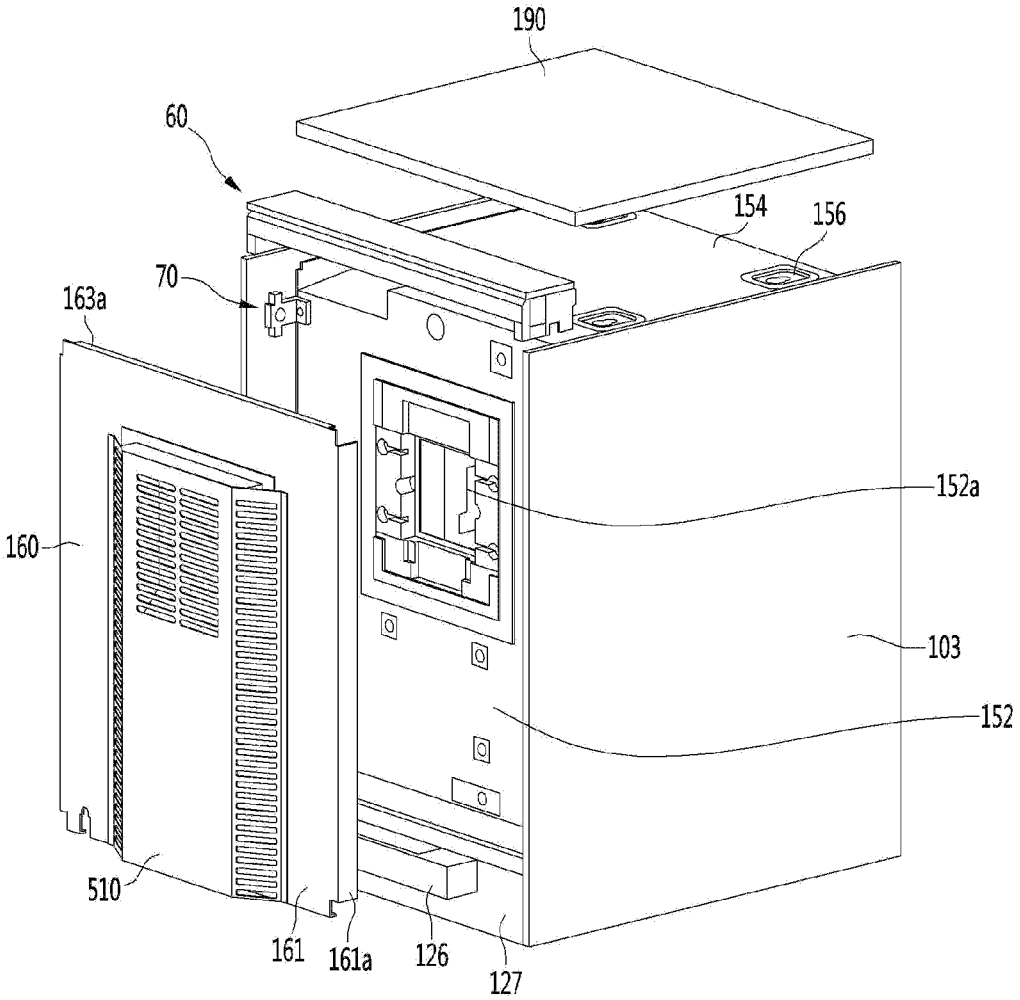
FIG. 6 is a rear perspective view illustrating some components of the refrigerator according to an embodiment of the present invention.

FIG. 4 is an exploded perspective view of the cabinet according to an embodiment of the present invention, FIG. 5 is a rear perspective view of the refrigerator according to an embodiment of the present invention, and FIG. 6 is a rear perspective view illustrating some components of the refrigerator according to an embodiment of the present invention.

Referring to FIGS. 1 to 6, the cabinet 10 according to an embodiment of the present invention may include an outer case 100, an inner case 110, and a cabinet cover 190.

The outer case 100 may include a pair of side panels 102 and 103. The pair of side panels 102 and 103 may define an outer appearance of a side surface of the refrigerator 1.

The outer case 100 may further include a rear panel 160 defining an outer appearance of a rear surface of the refrigerator 1.

Thus, the outer appearance of the refrigerator 1 excluding the door 20 may be defined by the pair of side panels 102 and 103, the cabinet cover 190 and the rear panel 160.

The cabinet 10 may further include a case supporter 130 supporting the inner case 110 and a base 120 coupled to a lower side of the case supporter 130.

The cabinet 10 may further include a middle plate 150 defining a foaming space together with the inner case 110. The middle plate 150 may cover upper and rear sides of the inner case 110 at a position that is spaced apart from the inner case 110.

The cabinet 10 may further include a cooling device 50 cooling the storage space 111.

The case supporter 130 may be disposed between the pair of side panels 102 and 103 in a state where the pair of side panels 102 and 103 are arranged in the horizontal direction. For example, the case supporter 130 may be screw-coupled to the pair of side panels 102 and 103 so as to be fixed.

In addition, the base 120 may be disposed below the case supporter 130. The base 120 may be disposed between the pair of side panels 102 and 103 and coupled to a lower side of the case supporter 130.

The base 120 may include a bottom plate 122. Although not limited, a front and rear length of the bottom plate 122 may be the same as or similar to that of each of the side panels 102 and 103. Thus, the bottom plate 122 may define an outer appearance of a bottom surface of the refrigerator 1.

The base 120 may further include a support rib 127 supporting the rear panel 160. The support rib 127 may extend upward from a rear end of the bottom plate 122. A handle 126 held by the user may be provided on a rear surface of the support rib 127.

The handle 126 may be gripped when the user wants to transport the refrigerator 1. As the handle 126 is provided on the support rib 127, the handle 126 is not visible from the outside when the refrigerator 1 is installed.

The rear surface of the support rib 127 may be disposed on the same plane as the rear end of each of the pair of side panels 102 and 103.

The handle 126 may protrude backward by a predetermined distance from the rear surface of the support rib 127.

The handle 126 may include an upper extension portion 126*b* extending in a horizontal direction from one point of the support rib 127, a front extension portion 126*d* extending downward from a front end of the upper extension portion 126*b*, and a pair of side extension portions 126*c* extending downward from both ends of the upper extension portion 126*b*.

A space 126*a* in which a user's hand is disposed may be defined by each of the extension portions 126*b*, 126*c*, and 126*d*

The front extension portion 126*d* may be disposed to be spaced a predetermined distance from the rear surface of the support rib 127. That is, even when the refrigerator 1 is disposed adjacent to one wall of the installation space, the rear panel 160, the support rib 127, and the display unit 60 to be described later may be spaced apart from the one wall by the front extension portion 126*d*.

Thus, a flow of air suctioned into the refrigerator 1 by the front extension portion 126*d* and the opening and closing of the display cover 650 of the display unit 60, which will be described later, may be smoothly performed without interfering with the one wall of the installation space.

A vertical length of the door 20 is less than that of each of the side panels 102 and 103.

The top surface of the door 20 may be disposed at the same height as the upper end 102*b* of each of the side panels 102 and 103.

Thus, in the state in which the door 20 closes the storage space 111, the door 20 is disposed higher than the base 120 so that a portion of the base 120 is exposed to the outside.

The inner case 110 may include a main frame 113 defining the storage space 111 and a front frame 112 extending in a vertical direction from a front edge of the main frame 113.

The main frame 113 may be formed in a rectangular parallelepiped shape having an opened front surface.

A front and rear length of the main frame 113 may be less than that of each of the side panels 102 and 103. In addition, a horizontal width of the main frame 113 may be formed to be less than an interval between the respective side panels 102 and 103. On the other hand, the horizontal width of the front frame 112 may be formed to have the same as the interval between the side panels 102 and 103.

When the inner case 110 is installed at the installation position, both side surfaces of the main frame 113 are spaced apart from the side panels 102 and 103, respectively. Thus, the foaming space in which a foaming liquid is filled is defined between both the side surfaces of the main frame 113 and the respective side panels 102 and 103.

In a state in which the inner case 110 is installed at the installation position, an upper end of the front frame 112 is disposed to be lower than the upper end 102*b* of each of the side panels 102 and 103. Thus, a space in which the cabinet cover 190 is disposed is defined above the front frame 112.

The middle plate 150 may cover the inner case 110 from the rear side of the inner case 110.

The middle plate 150 may include a rear plate 152 covering a rear surface of the inner case 110 and an upper plate 154 covering a top surface of the inner case 110.

The upper plate 154 may extend horizontally from an upper end of the rear plate 152. Thus, the middle plate 150 may be formed in a shape such as "—1".

The upper plate 154 may be seated on an upper end of the front frame 112. For example, the upper plate 154 may be attached to a top surface portion of the front frame 112 by an adhesive means.

In a state in which the upper plate 154 is seated on the front frame 112, the upper plate 154 is spaced apart from the top surface of the main frame 113. Thus, the foaming space is defined between the upper plate 154 and the top surface of the main frame 113.

The rear plate 152 may be installed on the base 120 and the pair of side panels 102 and 103.

A coupling rib (not shown) extending upward to install the rear plate 152 may be provided on the base 120. The coupling rib may be disposed at a relatively rear side rather than the rear surface of the main frame 113.

A coupling hole (not shown) for coupling of a bolt may be defined in the rear plate 152 and the coupling rib.

The rear plate 152 may be fixed to the base 120 by being coupled to the coupling rib by the bolt in a state of being in contact with a rear surface of the coupling rib.

The rear plate 152 may be spaced apart from the rear surface of the main frame 113. Thus, the foaming space is defined between the rear plate 152 and the rear surface of the main frame 113.

In addition, the rear plate 152 may be installed on the pair of side panels 102 and 103 by a fixing unit 70 (see FIG. 6) to be described later.

The fixing unit 70 may be coupled to a rear side of the rear plate 152, and the fixing unit 70 may be coupled to each of the side panels 102 and 103. Thus, not only the rear plate 152 is fixed to the side panels 102 and 103 by the fixing unit 70, but also deformation of the rear plate 152 during a process of filling the foaming liquid may be prevented.

An injection hole (not shown) for injection of the foaming liquid may be defined in the rear plate 152, and the injection hole may be blocked by a packing (not shown).

A through-hole 152*a* through which the cooling device 50 passes may be additionally defined in the rear plate 152.

In a state in which the installation of the middle plate 150 is completed, a top surface of the upper plate 154 may be disposed lower than the upper end 102*b* of each of the side panels 102 and 103. Thus, a space, in which the cabinet cover 190 is disposed, may be defined above the upper plate 154.

In addition, in a state in which the installation of the middle plate 150 is completed, the rear surface of the rear plate 152 is disposed to be spaced inward from the rear end 102*c* of each of the side panels 102 and 103. Thus, there is a space (rear heat dissipation passage) through which air for heat dissipation of the cooling device 50 flows at the rear side of the rear plate 152.

The rear panel 160 may cover the rear plate 152 from the rear side of the rear plate 152.

The rear panel 160 may include a panel body 161 that covers the rear surface of the rear plate 152 and a side extension portion 161*a* that allows a contact area between the pair of side panels 102 and 103 to increase.

The rear panel 160 may be coupled to the case supporter 130 at the rear side of the rear plate 152 in a state of being spaced apart from the rear plate 152. In detail, the panel body 161 may be coupled to the case supporter 130.

The panel body 161 may be disposed above the support rib 127 and coupled to the case supporter 130 by a coupling member such as a screw.

A coupling hole (not shown) for coupling with the case supporter 130 may be defined in a lower portion of the panel body 161.

In the state in which the panel body 161 is coupled to the case supporter 130, the panel body 161 may be disposed between the pair of side panels 102 and 103 while covering the rear side of the rear plate 152.

A vertical length of the panel body 161 may be less than that of each of the pair of side panels 102 and 103. In a state in which the panel body 161 is coupled to the case supporter 130, the upper end of the panel body 161 is disposed lower than the upper end 102*b* of each of the side panels 102 and 103.

Thus, a space in which the display unit 60 is disposed is defined above the panel body 161.

A horizontal width of the panel body 161 may be formed to be the same as the interval between the side panels 102 and 103.

In addition, in the state in which the panel body 161 is coupled to the case supporter 130, the rear surface of the panel body 161 may be disposed on the same plane as the rear surface of the display unit 60 and the rear ends 102*c* of the pair of side panels 102 and 103 so that the outer appearance of the cabinet 10 has the sense of unity.

Also, in the state in which the panel body 161 is coupled to the case supporter 130, the panel body 161 may be disposed on the same plane as the rear surface of the support rib 127.

Thus, the panel body 161 may define the outer appearance of the rear surface of the refrigerator 1 together with the display unit 60 and the support ribs 127.

The side extension portion 161*a* may extend vertically from both ends of the panel body 161 to the panel body 161. The side extension portion 161*a* may be formed on at least a portion of both the ends of the panel body 161.

In the state in which the rear panel 160 is coupled to the case supporter 130, the side extension portion 161*a* may be disposed between the pair of side panels 102 and 103.

In the state in which the side extension portion 161*a* is disposed between the pair of side panels 102 and 103, the side extension portion 161*a* may be in contact with the side panels 102 and 103. That is, the side extension portion 161*a* may be understood as a surface that is in contact with the pair of side panels 102 and 103 when the rear panel 160 is assembled.

The rear panel 160 may be supported by the pair of side panels 102 and 103 so as to be stably assembled due to the side extension portion 161*a*.

The cabinet cover 190 may be detachably coupled to the middle plate 150. In detail, a cover fixing portion 196 (see FIG. 10) for fixing the cabinet cover 190 to the middle plate 150 may be provided on a bottom surface of the cabinet cover 190.

A cover fixing hole 156 for fixing the cover fixing portion 196 may be provided in the middle plate 150. The cover fixing hole 156 may be provided in, for example, the upper plate 154.

An external air hole (not shown) through which external air is introduced may be defined in the rear panel 160, and the external air hole may be covered by a grill case 510. The grill case 510 may be coupled to the rear panel 160 from the rear side of the rear panel 160.

In addition, the grill case 510 may be supported by being seated on the top surface of the handle 126.

The grill case 510 may have a polygonal shape by bending a plate.

For example, the grill case 510 has a first surface spaced apart from the rear panel 160 and parallel to the rear panel 160, a second surface extending from an upper end of the first surface toward the rear panel 160, and a pair of third surfaces extending from side ends of the first surface toward the rear panel 160.

The third surface may extend from each of the side ends of the first surface so as to be inclined outward toward the rear panel 160. That is, the pair of third surfaces may move away from each other as the pair of third surfaces are closer to the rear panel 160.

A first external air suction hole 512 and a second external air suction hole 514 may be defined in the grill case 510.

The first external air suction hole 512 may be defined by a grill formed on the first surface. The second external air intake hole 514 may be defined by a grill formed on the third surface.

Thus, external air may be introduced into the refrigerator 1 through the first external air suction hole 512 and the second external air suction hole 514.

In addition, even if the first external air suction hole 512 is shielded by a curtain or wall due to the position of the second external air suction hole 514, the external air may be smoothly suctioned through the second external air suction hole 514.

A display unit 60 may be installed at a rear side of an upper end of the cabinet 10. The display unit 60 may be disposed at a rear side of the cabinet cover 190.

A portion of the display unit 60 may be covered by a display cover 650. The display cover 650 may cover the display panel 605 of the display unit 60.

When the display cover 650 covers the display panel 605, it is possible to prevent other components of the display unit 60 from being exposed to the outside. For example, the external exposure of the display panel 605 is prevented by the display cover 650.

The display cover 650 together with the cabinet cover 190 defines the top surface of the refrigerator 1. That is, in the state in which the display cover 650 covers the display panel 605, the top surface of the display cover 650 may be disposed at the same height as the top surface of the cabinet cover 190.

Thus, the top surfaces of the display cover 650 and the cabinet cover 190 may define a continuous surface. According to the present invention, since the external exposure of the configuration of the display unit 60 is prevented, the outer appearance of the refrigerator 1 is improved to be neat.

Since the display unit 60 is disposed above the cabinet 10, even if the height of the refrigerator 1 is low, the user may easily see the display panel 605 in the state in which the display cover 650 rotates.

Also, since the display cover 650 covers the display panel 605, even if water or liquid falls on the top surface of the refrigerator 1, the water or liquid may be prevented from flowing into the display unit 60.

Figure 7:
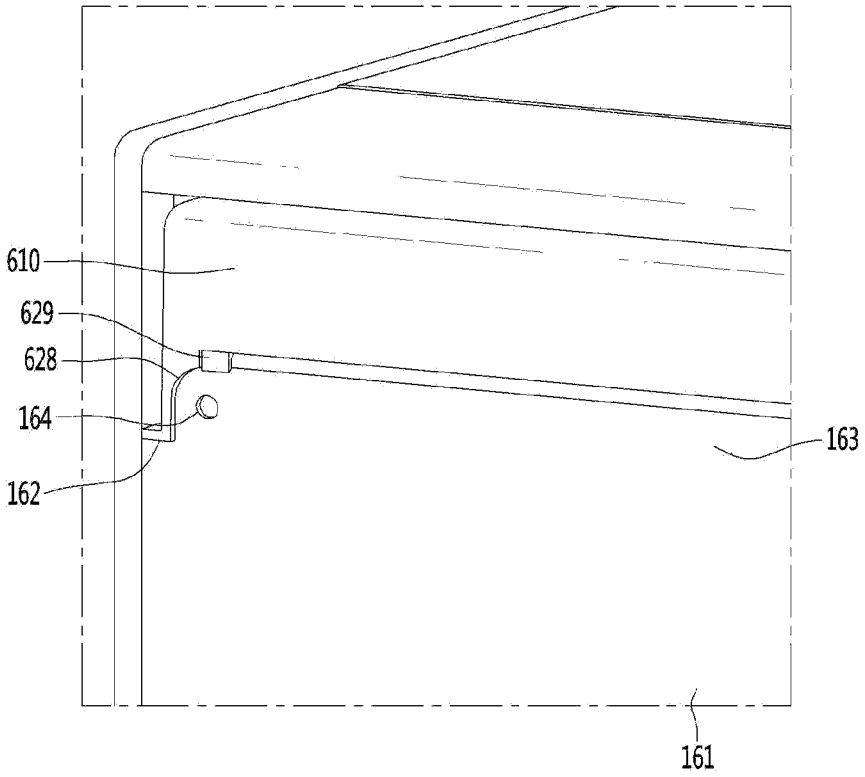
FIG. 7 is an enlarged view illustrating a portion A of FIG. 5.
Figure 8:
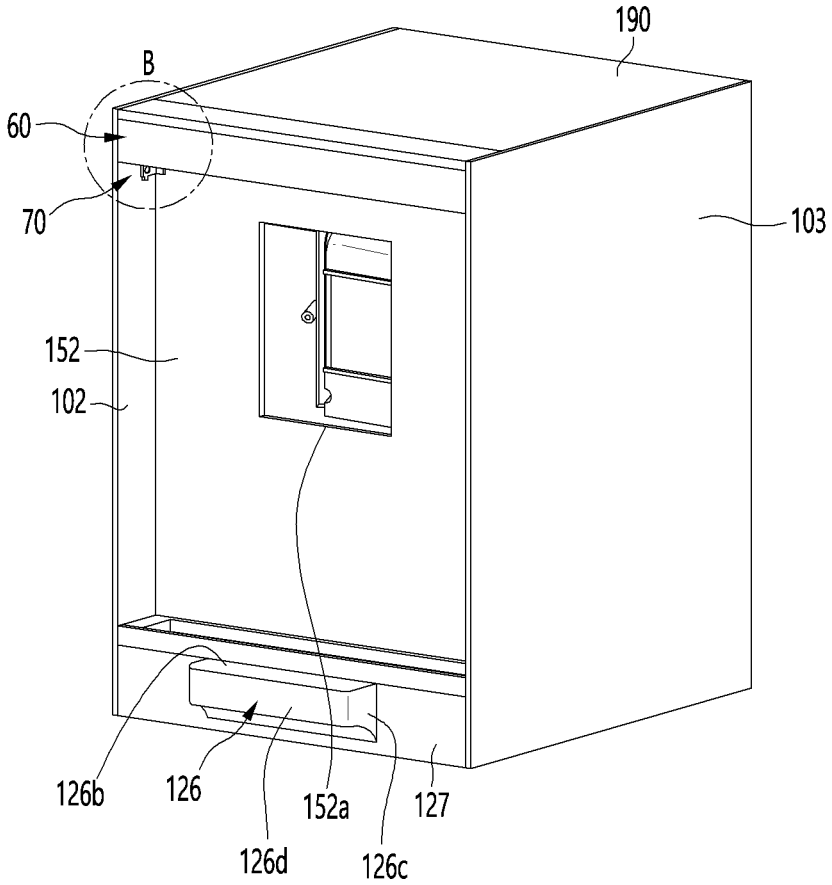
FIG. 8 is a view illustrating a state in which a display unit is assembled with a fixing unit in a state in which a rear panel is removed according to an embodiment of the present invention.
Figure 9:
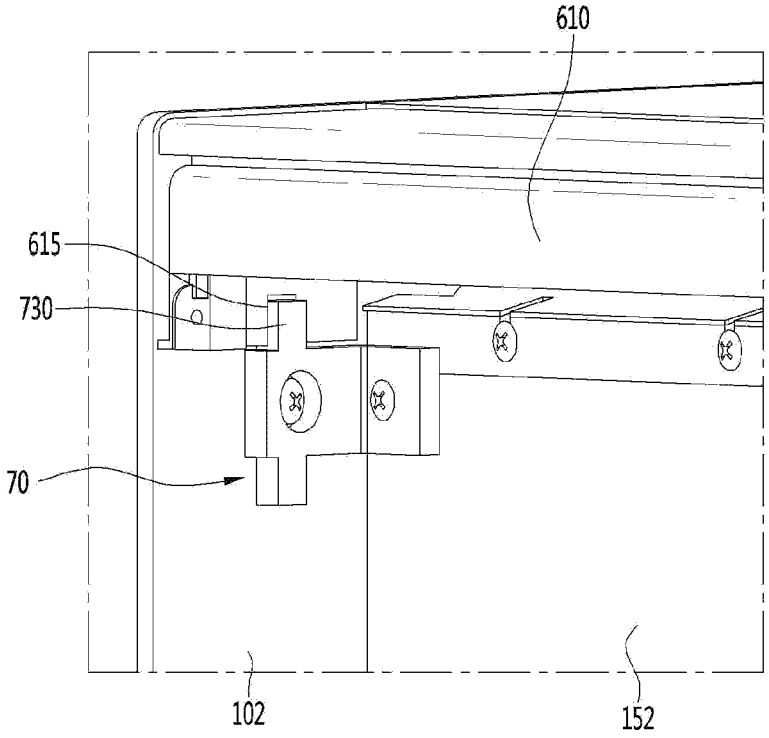
FIG. 9 is an enlarged view of a portion B of FIG. 8.
Figure 10:
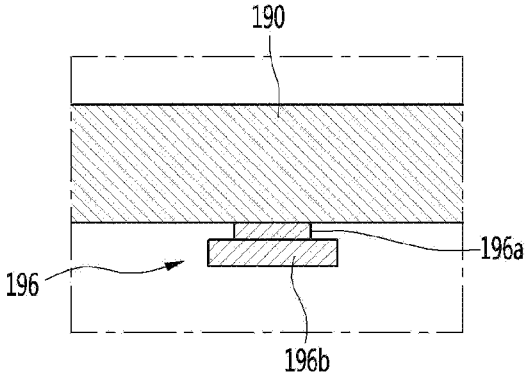
FIG. 10 is a cross-sectional view of a cover fixing portion provided on a cabinet cover according to an embodiment of the present invention.
Figure 11:
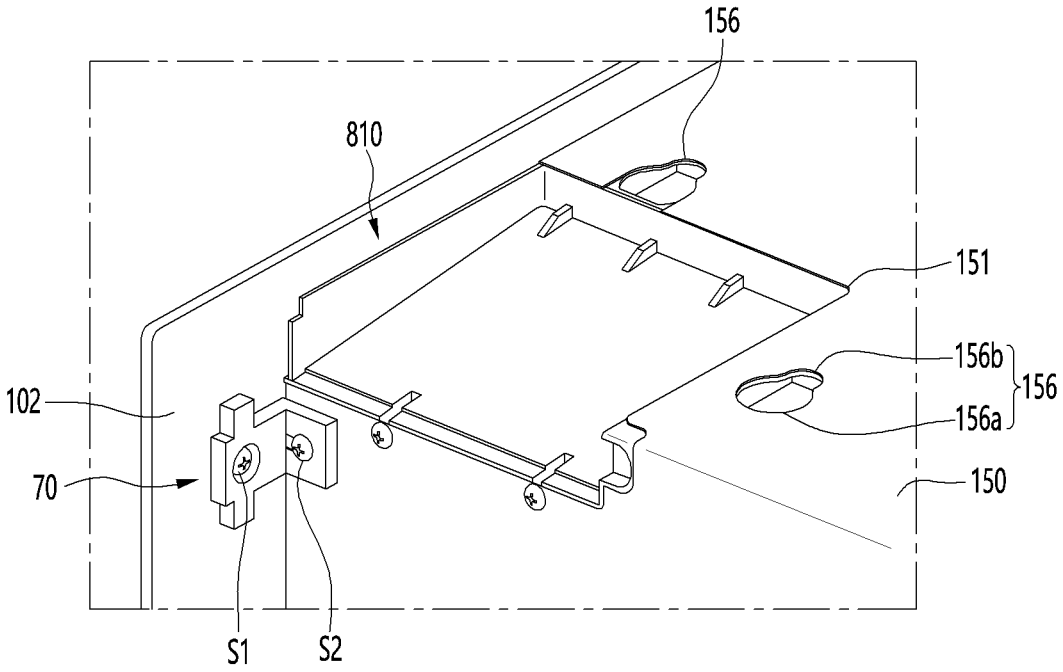
FIG. 11 is an enlarged view illustrating some components of a middle plate according to an embodiment of the present invention.

FIG. 7 is an enlarged view illustrating a portion A of FIG. 5, FIG. 8 is a view illustrating a state in which the display unit is assembled with the fixing unit in a state in which the rear panel is removed according to an embodiment of the present invention, FIG. 9 is an enlarged view of a portion B of FIG. 8, FIG. 10 is a cross-sectional view of the cover fixing portion provided on the cabinet cover according to an embodiment of the present invention, and FIG. 11 is an enlarged view illustrating some components of the middle plate according to an embodiment of the present invention.

Hereinafter, a fixing structure of the cabinet according to an embodiment of the present invention will be described.

Referring to FIGS. 7 to 11, the rear panel 160 may be coupled to the display unit 60.

The display unit 60 may be provided with a panel seating portion 628 on which the rear panel 160 is seated. In detail, the panel seating portion 628 may be formed on a rear surface of a display case 610 to be described later.

The rear panel 160 may further include a panel extension portion 163 extending to be coupled with the display unit 60.

The panel extension portion 163 may extend upward from an upper end of the rear panel 160. In detail, the panel extension portion 163 may be formed to extend upward from at least a portion of an upper end 162 (see FIG. 7) of the rear panel 160.

A vertical extension length of the panel extension portion 163 may correspond to a vertical length of the panel seating portion 628. In a state in which the panel extension portion 163 is seated on the panel seating portion 628, an upper end of the panel extension portion 163 may be disposed lower than a lower end of the rear surface portion 623 (see FIG. 13) of the display unit 60 to be described later.

Thus, in the state in which the panel extension portion 163 is seated on the panel seating portion 628, a panel seating protrusion 629, which will be described later, may be seated on the upper end of the panel extension portion 163.

Both ends of the panel extension portion 163 may correspond to the shape of the panel seating portion 628. For example, each of both the ends of the panel extension portion 163 may be rounded to correspond to the shape of the panel seating portion 628.

Each of both the ends of the panel extension portion 163 may be rounded upward from the upper end 162 of the panel body 161.

The rear panel 160 may be coupled to the display unit 60. The rear panel 160 may be coupled to the display unit 60 by, for example, a third bolt S3. A first bolt coupling hole 164 to which the third bolt S3 is coupled may be defined in each of both the ends of the panel extension portion 163.

In the state in which the rear panel 160 is seated on the panel seating portion 628, the first bolt coupling hole 164 may be aligned with a second bolt coupling hole 626*a* (see FIG. 13) defined in the display case to be described later in the front and rear direction.

Referring to FIGS. 6 and 7, the rear panel 160 may further include a support portion 163*a* extending from the panel extension portion 163. The support portion 163*a* may extend from the panel extension portion 163 and be supported by a support rib 625 of the display case 610, which will be described later.

The support portion 163*a* may be bent from an upper end of the panel extension portion 163 so as to be in contact with the support rib 625. The rear panel 160 and the display unit 60 may be stably coupled by the support portion 163*a*.

For example, the support portion 163*a* may extend horizontally from the upper end of the panel extension portion 163. In this case, the support portion 163*a* may be in line contact with the support rib 625 of the display case 610.

Alternatively, the support portion 163*a* may be bent to extend in a "1" shape from the upper end of the panel extension portion 163. In this case, the support portion 163*a* may be in surface contact with the support rib 625 of the display case 610.

In detail, the fixing unit 70 may be bent in an approximately "ㄴ" shape. Thus, the first bolt S1 may pass through a portion of the fixing unit 70 and be coupled to the side panels 102 and 103, and the second bolt S2 may pass through the other portion of the fixing unit 70 and be coupled to the middle plate 150.

The fixing unit 70 may be coupled to the rear plate 152 and each of the side panels 102 and 103 from the rear side of the rear plate 152. Thus, not only the rear plate 152 is fixed to the side panels 102 and 103 by the fixing unit 70, but also deformation of the rear plate 152 during a process of filling the foaming liquid may be prevented.

Also, the display unit 60 may be mounted on the refrigerator 1 by the fixing unit 70. In detail, the fixing protrusion 730 may be provided on the fixing unit 70 so that the fixing protrusion 730 is inserted into the protrusion accommodation portion 615 of the display unit 60.

When the display unit 60 is assembled with the fixing protrusion 730 so that the fixing protrusion 730 is inserted into the protrusion accommodation portion 615 of the display unit 60, the display unit 60 may be disposed above the fixing unit 70.

After the display unit 60 is assembled by the fixing protrusion 730 of the fixing unit 70, when the rear panel 160 is coupled to the display case 610, the position of the display unit 60 may be fixed.

On the other hand, when the coupling of the rear panel 160 and the display case 610 is released from each other, the display unit 60 may be separated from the fixing protrusion 730 of the fixing unit 70 to easily release the coupling in position of the display unit 60. A detailed description with respect to disassembly of the display unit 60 and the fixing protrusion 730 will be described later.

The refrigerator according to this embodiment may further include a module mounting case 810 for mounting a wireless charging module capable of wirelessly charging a battery of a mobile device and a cutoff portion 151 for mounting the module mounting case 810.

The module mounting case 810 may be coupled to the middle plate 150, for example, by a screw.

The cutoff portion 151 may be disposed at an upper corner portion of the middle plate 150. The module mounting case 810 may be disposed on the upper rear portion of the refrigerator 1 by the position of the cutoff portion 151.

In the state in which the wireless charging module is mounted on the module mounting case 810, the wireless charging module may be covered by the cabinet cover 190.

The module mounting case 810 may be formed so that the rear is opened. The wireless charging module may be mounted or detached through the rear opening.

The module mounting case 810 may be mounted on the middle plate 150 by the cutoff portion 151 to adhere to an inner surface of the middle plate 150.

In addition, the module mounting case 810 may be screw-coupled to the middle plate 150 in the state of being seated on the middle plate 150.

The cabinet cover 190 may be detachably coupled to the middle plate 150. In detail, as the cover fixing portion 196 provided on the cabinet cover 190 is inserted into the cover fixing hole 156 defined in the middle plate 150, the cabinet cover 190 may be attached to and detached from the middle plate 150.

The cover fixing portion 196 may be provided on a bottom surface of the cabinet cover 190. For example, the cover fixing portion 196 may be attached to the bottom surface of the cabinet cover 190 by an adhesive means. The adhesive means may include an adhesive or a double-sided tape, and it is noted that there is no limitation in types of the adhesive means in the present invention.

As another example, the cover fixing portion 196 may be fixed to the bottom surface of the cabinet cover 190 by a screw.

In order to firmly fix the cabinet cover 190 to the middle plate 150, a plurality of cover fixing portions 196 may be provided.

The plurality of cover fixing portions 196 may be arranged to be spaced apart from each other in the horizontal direction of the cabinet cover 190 and may be arranged to be spaced apart from each other in the front and rear direction.

Referring to FIG. 10, each of the cover fixing portions 196 may include a first portion 196*a* and a second portion 196*b* having a diameter or a size greater than that of the first portion 196*a*.

The first portion 196*a* is disposed between the cabinet cover 190 and the second portion 196*b*, and the first portion 196*a* is in contact with a bottom surface of the cabinet cover 190.

The cover fixing hole 156 may be defined in the upper plate 154. The cabinet cover 190 may be coupled to the upper plate 154 by the cover fixing hole 156 and the cover fixing portion 196 of the cabinet cover 190.

That is, the cabinet cover 190 may be mounted on the upper plate 154 to be fixed in position and simultaneously may cover the upper side of the upper plate 154.

A plurality of cover fixing holes 156 may be defined. Some of the plurality of cover fixing holes 156 may be defined to be adjacent to the cutoff portion 151.

In addition, some of the plurality of cover fixing holes 156 may be disposed to be adjacent to the cutoff portion 151. That is, some of the plurality of cover fixing holes 156 may be disposed to be adjacent to the module mounting case 810.

The cover fixing hole 156 may include a first hole 156*a* having a size equal to or greater than that of the second portion 196*b* of the cover fixing portion 196 and a second hole 156*b* extending from the first hole 156*a* and having a size less than that of the first hole 156*a*.

The second hole 156*b* may be defined to be less than the second portion 196*b* of the cover fixing portion 196. The second hole 156*b* may have a size that is equal to or greater than that of the first portion 196*a* of the cover fixing portion 196.

In order to fix the cover fixing portion 196 to the middle plate 150, the second portion 196*b* of the cover fixing portion 196 and the first hole 156*a* of the cover fixing hole 156 are aligned with each other.

Next, the second portion 196*b* of the cover fixing portion 196 passes through the first hole 156*a* of the cover fixing hole 156.

In the state in which the second portion 196*b* of the cover fixing portion 196 passes through the first hole 156*a* of the cover fixing hole 156, the first portion 196*a* of the cover fixing portion 196 is disposed within the first hole 156*a*, and the cabinet cover 190 is seated on the upper plate 154.

In this state, the cabinet cover 190 horizontally moves so that the first portion 196*a* of the cover fixing portion 196 is disposed in the second hole 156*b* of the cover fixing hole 156. For example, the cabinet cover 190 may move backward.

When the first portion 196*a* of the cover fixing portion 196 is disposed in the second hole 156*b* of the cover fixing hole 156, the second portion 196*b* of the cover fixing portion 196 is in contact with a bottom surface of the upper portion plate 154.

Thus, the separation of the cabinet cover 190 from the middle plate 150 may be prevented unless the cabinet cover 190 is pushed backward.

In addition, in the state in which the cover fixing portion 196 is disposed in the second hole 156*b*, the rear surface 190*b* of the cabinet cover 190 may be in contact with a front surface 611 (see FIG. 12) of the display case 610 of the display unit 60 to be described later.

That is, in the state in which the cabinet cover 190 is fixed to the middle plate 150, the top surface of the cabinet cover 190 and the display unit 60 may be disposed to have a sense of unity.

In the present invention, since the cabinet cover 190 is coupled to the middle plate 150 in a sliding manner, the cabinet cover 190 may be easily coupled to the middle plate 150 and easily separated from the middle plate 150.

According to the present invention, there is an advantage that the cabinet cover 190 is capable of being replaced. That is, since the cabinet cover 190 having a design or color desired by the user is coupled to the middle plate 150, there is an advantage that the design of the outer appearance of the refrigerator 1 may be diversified.

In addition, according to the present invention, when the cabinet cover 190 is damaged, there is an advantage that the cabinet cover 190 is capable of being replaced. When the user uses the refrigerator 1 as the side table refrigerator, the user may be easily accessible to the cabinet cover 190 and uses the refrigerator 1 for the purpose of the side table, and thus, there is a high risk of damage or the like.

That is, even if the cabinet cover 190 is damaged during the user's use, since the damaged cabinet cover 190 is removed and replaced with a new cabinet cover 190, there is an advantage in that the service is improved.

When the assembly of the cabinet cover 190 is completed, the rear surface 190*b* of the cabinet cover 190 may be disposed inside the rear end 102*c* of each of the side panels 102 and 103.

Thus, there is a space, in which the display unit to be described later is disposed, at the rear side of the cabinet cover 190.

The fixing unit 70 may be disposed lower than the module mounting case 810 and the cutoff portion 151 in a state of being coupled to the rear side of the rear plate 152. Therefore, when the module mounting case 810 is mounted or separated, an interference due to the fixing unit 70 may be prevented.

Figure 12:
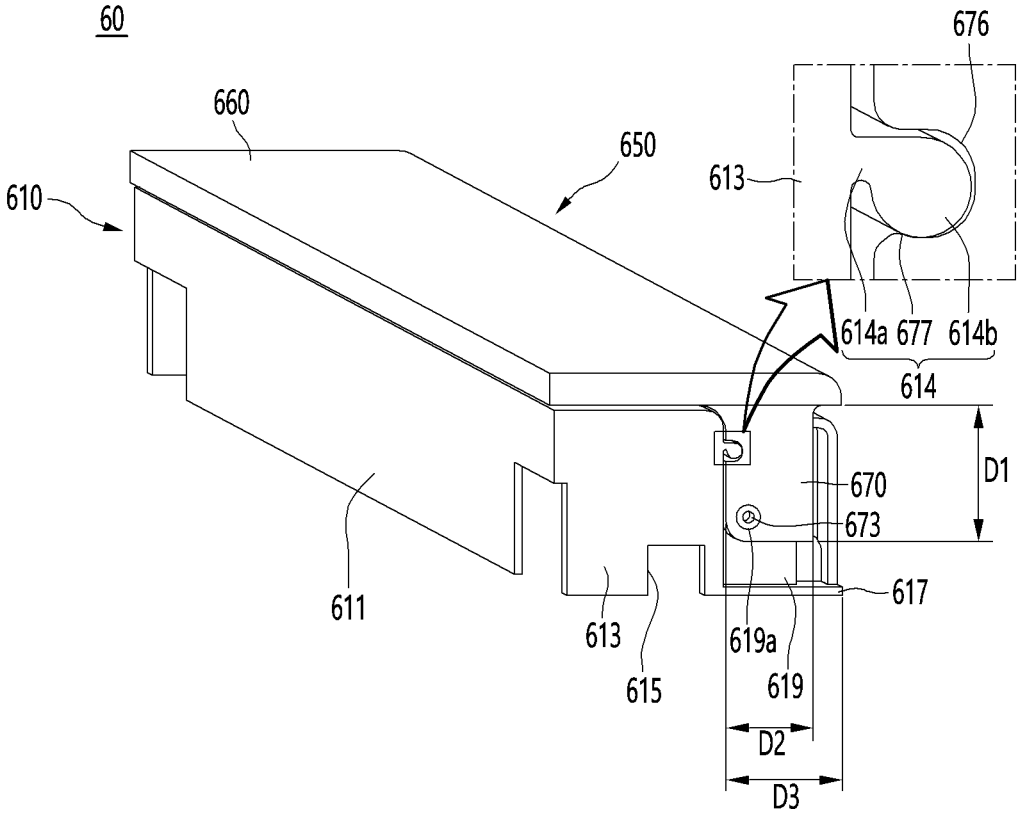
FIG. 12 is a perspective view of the refrigerator according to an embodiment of the present invention.
Figure 13:
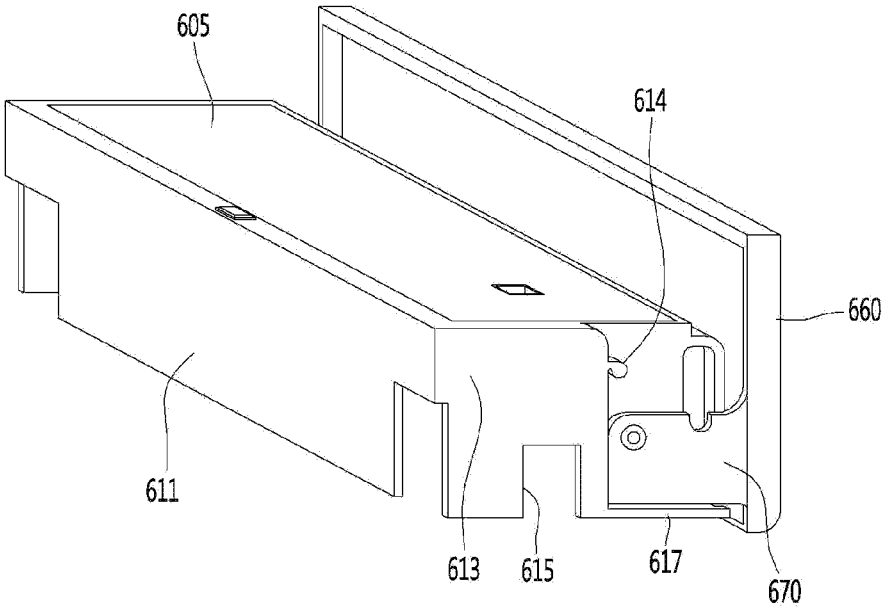
FIG. 13 is a view illustrating a state in which a display cover of FIG. 12 rotates.
Figure 14:
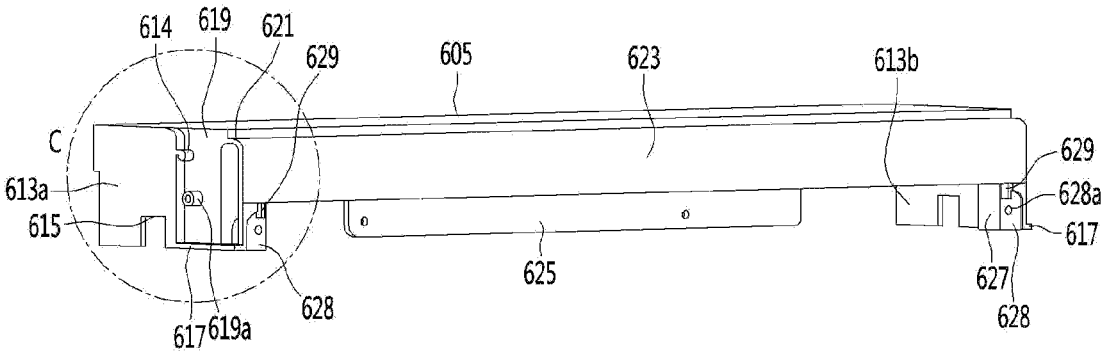
FIG. 14 is a perspective view of the display case according to an embodiment of the present invention.
Figure 15:
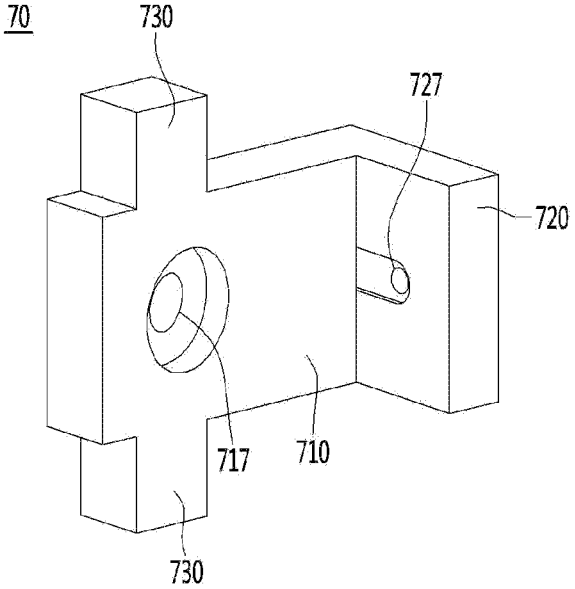
FIG. 15 is a perspective view of the fixing unit according to an embodiment of the present invention.

FIG. 12 is a perspective view of the refrigerator according to an embodiment of the present invention, FIG. 13 is a view illustrating a state in which the display cover of FIG. 12 rotates, FIG. 14 is a perspective view of the display case according to an embodiment of the present invention, and FIG. 15 is a perspective view of the fixing unit according to an embodiment of the present invention.

Referring to FIGS. 12 to 15, the refrigerator 1 may further include the display unit 60 and the fixing unit 70 for assembling the display unit 60.

The display unit 60 may include a display case 610, a display PCB (not shown) accommodated in the display case 610, a display panel 605 that covers an upper side of the display PCB, and a display cover 650 that covers an upper side of the display panel 605.

The display panel 605 may be coupled to the upper side of the display case 610. Light irradiated from one or more light emitting portions installed in the display PCB may pass through the display panel 605.

The display case 610 may be seated between, for example, the side panels 102 and 103. As the display case 610 and the fixing unit 70 are assembled, the display case 610 may be installed between the side panels 102 and 103.

For example, a protrusion accommodation portion 615 to be described later may be defined in the display case 610, and the fixing protrusion 730 of the fixing unit 70 may be inserted into the protrusion accommodation portion 615 so that the display case 610 and the fixing unit 70 are assembled.

Also, in the state in which the fixing protrusion 730 is inserted into the protrusion accommodation portion 615 of the display case 610, the display unit 60 may be disposed at the rear side of the cabinet cover 190.

The display cover 650 may be rotatably coupled to the display case 610. As another example, the display cover 650 may be rotatably coupled to one component of the cabinet 10.

For example, the display cover 650 may cover the display panel 605 in a state of being coupled to each of the side panels 102 and 103.

The display cover 650 may include a cover plate 660 for covering the top surface of the display panel 605 and a pair of extension portions 670 extending from both ends of the cover plate 660.

The pair of extension portions 670 may be coupled to both surfaces of the display case 610. In the state in which the pair of extension portions 670 are coupled to the display case 610, a seating groove 619 for seating each of the extension portions 670 may be defined in each of both sides of the display case 610 so that the pair of extension portions 670 do not protrude outward.

In the state in which the display unit 60 is assembled with the fixing unit 70, each of the extension portions 670 may be disposed between a portion of the display case 610 and each of the side panels 102 and 103.

The seating groove 619 may be disposed at a rear side of the protrusion accommodation portion 615. That is, each of the extension portions 670 seated in the seating groove 619 may be prevented from interfering with the protrusion accommodation portion 615 and the fixing protrusion 730 accommodated in the protrusion accommodation portion 615 during the rotation.

A hinge shafts 619*a* for providing a center of rotation of the display cover 650 may be provided on each of both surfaces of the display case 610.

The hinge shaft 619*a* may protrude from the display case 610 to both sides. The hinge shaft 619*a* may be formed in the seating groove 619.

In detail, the hinge shaft 619*a* may be formed to protrude from an outer surface of the seating groove 619.

A shaft hole 673 through which the hinge shaft 619*a* passes may be defined in each of the extension portions 670.

In the state in which the hinge shaft 619*a* passes through the shaft hole 673, the display cover 650 may rotate around the hinge shaft 619*a*.

The display cover 650 may rotate within a range between a first position, at which the display panel 605 is covered, and a second position at which the display panel 605 is exposed to the outside.

In the state in which the display cover 650 rotates to the first position, a rotation preventing protrusion 614 may be formed on one of the display case 610 and the display cover 650, and a protrusion groove 676, in which the rotation preventing protrusion 614 may be accommodated in the other one so that the display cover 650 is fixed in position.

For example, in FIG. 12, a structure, in which the rotation preventing protrusion 614 is formed on the display case 610, and the protrusion groove 676 is formed on the extension portion 670 of the display cover 650, is illustrated.

The rotation preventing protrusion 614 may include a neck portion 614*a* and an insertion portion 614*b* having a width greater than that of the neck portion 614*a*.

The insertion portion 614*b* may be rounded to be accommodated in the protrusion groove 676 during the rotation of the display cover 650. The insertion portion 614*b* may be formed in a substantially circular shape.

A radius of the insertion portion 614*b* may be equal to or greater than a width of the neck portion 614*a*.

A hook protrusion 677 may be formed in the protrusion groove 676 so as to be hooked to the insertion portion 614*b* in a state in which the insertion portion 614*b* is inserted. Thus, in a state in which the insertion portion 614*b* is inserted into the protrusion groove 676 and hooked on the hook protrusion 677, unless rotational force greater than a predetermined intensity or more is applied to the display cover 650, the display cover 650 may not rotate. That is, it is possible to prevent the display cover 650 from unintentionally rotating from the first position to the second position.

At the second position, the cover plate 660 may be spaced a predetermined distance from the rear surface of the display case 610. In detail, at the second position, the cover plate 660 may be spaced a predetermined distance from a panel seating protrusion 629 (see FIG. 14) to be described later.

Thus, it is possible to prevent the cover plate 660 from interfering with the panel seating protrusion 629 when the display cover 650 rotates.

The cover plate 660 may be spaced a predetermined distance from the top surface of the display panel 605.

An extension length d1 of the extension portion 670 may be less than a vertical length of the display case 610. The extension length d1 of the extension portion 670 may be less than a vertical length of the seating groove 619.

That is, a lower end of the extension portion 670 is disposed higher than a lower end of the seating groove 619.

In addition, a front and rear width d3 of the extension portion 670 is less than a distance from a time at which the seating groove 619 is formed, to the rear surface (rear portion 623 to be described later) of the display case 610.

That is, in the first position, the rear end of the extension portion 670 may be disposed in front of a rear surface (a rear portion 623 to be described later) of the display case 610.

The display case 610 may include a front portion 611 disposed at a front side, a pair of side surface portions 613 formed at left and right sides, a support portion 617 extending backward from each of the side surface portions 613, and a rear portion 623 extending downward from a rear end of the display panel 605.

The front portion 611 may be disposed at the rear side of the cabinet cover 190 in a state in which the display unit 60 is assembled to the fixing unit 70. At least a portion of the front portion 611 may be in contact with the rear surface 190*b* of the cabinet cover 190.

Also, the front portion 611 may be disposed on the same plane as the front surface of the cover plate 660.

The pair of side surface portions 613 may be disposed to face the side panels 102 and 103, respectively. An outer surface of each of the side surface portions 613 may be disposed closer to each of the side panels 102 and 103 than the outer surface of the seating groove 619 and the outer surface of the extension portion 670.

For example, the side surface portions 613 may be in contact with the side panels 102 and 103, respectively.

In the state in which the display cover 650 is mounted on the display case 610, the outer surface of the extension portion 670 may be disposed inside the outer surface of the side surface portion 613. That is, the outer surface of the extension portion 670 may be disposed farther from each of the side panels 102 and 103 than the outer surface of the side surface portion 613.

Thus, when the display cover 650 rotates, the extension portion 670 is prevented from causing friction with the pair of side panels 102 and 103 to smoothly rotate.

The support portion 617 may be disposed below the seating groove 619. The support portion 617 may extend from the side surface portion 613 toward the rear surface of the display case 610.

That is, the seating groove 619 may be recessed downward from the upper end of the display case 610 to the support portion 617 and may extend from the rear end of the side surface portion 613 to the rear surface of the display case 610.

At the first position, a lower end of the extension portion 670 may be spaced apart from the support portion 617. In addition, at the second position, the rear end of the extension portion 670 may be supported by the support portion 617 and be prevented from excessively rotating.

The support portion 617 may be disposed on the same plane as the side surface portion 613. Thus, when the display case 610 is mounted on the fixing unit 70, the support portion 617 is supported by the pair of side panels 102 and 103 together with the side surface portion 613, and thus, the display unit 60 may be installed stably.

In addition, since the support portion 617 is supported by the side panels 102 and 103 at the lower side of the seating groove 619 and the extension portion 670, the rotation of the display cover 650 may be stably performed without distortion.

A front and rear length d2 of the support portion 617 may be less than the extension length d1 of the extension portion 670 and greater than the front and rear width d3 of the extension portion 670.

Thus, when the display cover 650 rotates, the cover plate 660 and the extension portion 670 may be stably supported at the second position without the cover plate 660 interferes with the support portion 617.

The display case 610 may further include a protrusion accommodation portion 615 into which the fixing protrusion 730 of the fixing unit 70 is inserted. The protrusion accommodation portion 615 may be formed in the side surface portion 613.

In detail, the protrusion accommodation portion 615 may be formed to extend upward from the lower end of the side surface portion 613. The protrusion accommodation portion 615 may be understood to have a shape of a groove that is recessed upward from the lower end of the side surface portion 613.

An upper end of the protrusion accommodation portion 615 may be formed to be lower than the height of each of the hinge shaft 619*a* and the shaft hole 673.

In addition, the protrusion accommodation portion 615 may be formed to correspond to the shape of the fixing protrusion 730. The protrusion accommodation portion 615 and the fixing protrusion 730 may be formed, for example, in a polygonal shape. In the drawings, for example, it is illustrated that each of the protrusion accommodation portion 615 and the fixing protrusion 730 is formed in a rectangular shape.

The display case 610 may further include a horizontal portion 621 horizontally extending backward from the rear end of the display panel 605. A top surface of the horizontal portion 621 may be disposed lower than the top surface of the display panel 605.

That is, since the rear portion of the cover plate 660 is spaced apart from the horizontal portion 621, an interference by the horizontal portion 621 when the display cover 650 rotates may be prevented from occurring.

The rear portion 623 may extend downward from a rear end of the horizontal portion 621. An extension length of the rear portion 623 may be less than a vertical length of each of the front portion 611 and the side surface portion 613.

A lower end of the rear portion 623 is disposed higher than the lower end of each of the front portion 611 and the side surface portion 613. In addition, a lower end of the rear portion 623 may be formed to be higher than the top surface of the support portion 617.

Thus, a space in which the panel extension portion 163 of the rear panel 160 is disposed is formed under the rear panel 623.

A connection portion between the horizontal portion 621 and the rear portion 623 may be formed to be round. The rotation of the cover plate 660 may be guided by the rounded shape.

A rear surface of the rear portion 623 may be defined as a rear surface of each of the display unit 60 and the display case 610.

The rear surface of the support portion 617 may be disposed on the same plane as the rear surface of the rear portion 623. Thus, when the rear panel 160 is seated on the panel seating portion 628, the rear surface of the support portion 617, the rear portion 623, and the rear panel 160 form a sense of unity.

In addition, an outer surface of the seating groove 619 may be disposed on the same plane as a side surface of the rear portion 623. Thus, when the display cover 650 rotates from the first position to the second position, the extension portion 670 may rotate smoothly without interfering with the side surface of the rear portion 623.

A panel seating portion 628 for seating the rear panel 160 may be formed on the rear surface of the display unit 60. The panel seating portion 628 may be formed by being recessed forward from the rear surface of the display unit 60.

The panel seating portion 628 may be disposed below the rear portion 623. In detail, the panel seating portion 628 may be disposed below both ends of the rear portion 623.

The display case 610 may further include a pair of protrusions 627 extending downward from both the ends of the rear portion 623. The pair of protrusions 627 may extend inward from the support portion 617 and the seating groove 619.

A thickness of the protrusion 627 may be greater than that of the side surface portion 613. That is, an inner surface of the protrusion 627 may be disposed on the inside rather than the inner surface 613*b* of the side surface portion 613 and may be disposed further away from each of the side panels 102 and 103.

An area on which the panel extension portion 163 of the rear panel 160 is seated may increase due to the thickness of the protrusion 627, and thus, the rear panel 160 may be stably seated.

The rear surface of the protrusion 627 may be disposed on the same plane as the rear surface of the rear portion 623 and the rear surface of the support portion 617.

The panel seating portion 628 may be formed to be recessed forward from the rear surface of the protrusion 627. Here, the "front side" may be understood as a direction toward the front portion 611 or a direction toward the storage space 111 and the door 20.

A recessed depth of the panel seating portion 628 may be the same as the thickness of the panel body 161 of the rear panel 160. That is, when the rear panel 160 is seated on the panel seating portion 628, the rear panel 160, the rear surface of the protrusion 627, and the rear surface of the rear surface portion 623 may form a sense of unity.

The shape of the panel seating portion 628 may be formed to correspond to the shape of each of both ends of the panel extension portion 163. For example, a portion of the panel seating portion 628 may be formed to be rounded with a predetermined curvature.

The curvature of each of both the ends of the panel extension portion 163 may be the same as that of a portion of the panel seating portion 628.

The display case 610 may further include a panel seating protrusion 629 for mounting with the rear panel 160. The panel seating protrusion 629 may be disposed below the rear portion 623.

The panel seating protrusion 629 may be disposed above the panel seating portion 628. In the state in which the panel extension portion 163 of the rear panel 160 is seated on the panel seating portion 628, the panel seating protrusion 629 may be seated on the upper end of the panel extension portion 163.

Thus, the rear panel 160 may be seated on the panel seating portion 628, and the panel seating protrusion 629 of the display case 610 may be seated on the rear panel 160, and thus, the display unit 60 and the rear panel 160 may be firmly coupled to each other.

A second bolt coupling hole 628*a* through which the third bolt S3 is coupled may be defined in the display case 610 for coupling with the rear panel 160. The second bolt coupling hole 628*a* may be defined in the panel seating portion 628.

The second bolt coupling hole 628*a* may be aligned with the first bolt coupling hole 164 of the panel extension portion 163 in the state in which the rear panel 160 is seated on the panel accommodation portion 628. Thus, the third bolt S3 may be coupled by sequentially passing through the first bolt coupling hole 164 and the second bolt coupling hole 628*a*.

The display case 610 may further include a support rib 625 for supporting the rear panel 160. The support rib 625 may extend downward from a lower end of the rear portion 623.

Here, the support rib 625 may be defined as a "panel support rib".

A horizontal length of the support rib 625 may be less than that of the rear portion 623. The support rib 625 may be disposed between the pair of protrusions 627.

In addition, a thickness of the support rib 625 may be less than that of the rear portion 623.

For example, a rear surface of the support rib 625 may be disposed on the same plane as the panel seating portion 628. When a portion of the panel extension portion 163 of the rear panel 160 is seated on the panel seating portion 628, the other portion of the panel extension portion 163 may be seated on the support rib 625.

As another example, the rear surface of the support rib 625 may be disposed in front of the panel seating portion 628. When a portion of the panel extension portion 163 of the rear panel 160 is seated on the panel seating portion 628, the support portion 163*a* of the rear panel 160 may be seated on the support rib 625.

Thus, since the area on which the rear panel 160 is seated increases by the support rib 625, the rear panel 160 may be stably seated.

The fixing unit 70 may include a fixing protrusion 730 for fixing with the display case 610. When the fixing protrusion 730 is accommodated in the protrusion accommodation portion 615 of the display case 610, the display unit 60 may be detachably fixed to the fixing unit 70.

The fixing unit 70 may include a first body 710 disposed to face the side panels 102 and 103.

In addition, the fixing unit 70 may include a second body 720 disposed to face the middle plate 150. The second body 720 may be bent from the first body 710.

That is, the fixing unit 70 may be formed in an approximately "1 ⊥" shape.

The first body 710 and the second body 720 may be connected to cross each other. It should be noted that the first body 710 and the second body 720 are integrally formed.

For example, the first body 710 and the second body 720 may be disposed to be perpendicular to each other.

One of the first body 710 and the second body 720 may be coupled to the middle plate 150, and the other may be coupled to the side panels 102 and 103.

Referring to FIG. 11, the first body 710 may be coupled to the side panels 102 and 103, and the second body 720 may be coupled to the rear plate 152 of the middle plate 150.

As another example, the first body 710 may be coupled to the side panels 102 and 103. The fixing unit 70 may be fixed to the cabinet 10 by the first body 710.

As another example, the second body 720 may be coupled to the middle plate 150. The fixing unit 70 may be fixed to the cabinet 10 by the second body 720.

The fixing protrusion 730 may be provided on the first body 710. The fixing protrusion 730 may extend upward or downward from an upper end or lower end of the first body 710.

For example, the fixing protrusion 730 may be provided on any one of an upper end and a lower end of the first body 710.

Referring to FIG. 15, the fixing protrusion 730 may be provided on both the upper end and the lower end of the first body 710. The fixing protrusions 730 provided at the upper end and lower end of the first body 710 may be formed in the same manner.

That is, even when the fixing unit 70 is coupled to any of the pair of side panels 102 and 103, the fixing protrusion 730 may be inserted into the protrusion accommodation portion 615 of the display case 610 by the fixing protrusions 730, which are provided in plurality.

Thus, as the fixing unit 70 provides the plurality of fixing protrusions 730, since the fixing unit 70 performs the same role at both the left and right sides of the refrigerator 1, a common use of the fixed unit 70 may be possible.

That is to say, since there is no need to separately manufacture the fixing unit 70 provided at the left or right side of the refrigerator 1, productivity may increase, and production costs may be reduced.

An area of the first body 710 may be greater than that of the second body 720. Since the area on which the display case 610 is seated on the fixing unit 70 increases due to the relatively large area of the first body 710, the stable coupling may be possible.

The fixing protrusion 730 may be formed at a position that is insertable into the protrusion accommodation portion 615 of the display case 610 among the upper ends of the first body 710.

In detail, a distance from the front end of the side surface portion 613 to the protrusion accommodation portion 615 may be the same as a distance from the second body 720 to the fixing protrusion 730.

Thus, when the fixing protrusion 730 is inserted into the protrusion accommodation portion 615, the lower end of the side surface portion 613 of the display case 610 may be seated on the upper end of the first body 710 and may be supported by the fixing unit 70.

As another example, the fixing protrusion 730 may be provided on the second body 720. In this case, the position of the protrusion accommodation portion 615 in the display case 610 may be changed to a position into which the fixing protrusion 730 of the second body 720 is inserted.

In addition, a thickness of each of the first body 710 and the fixing protrusion 730 may be formed to be thicker than the thickness of the side surface portion 613. That is, the display case 610 may be stably seated and supported on the fixing unit 60 due to the thickness difference.

In addition, a protrusion height of the fixing protrusion 730 may be formed to be the same as the height of the protrusion accommodation portion 615. Thus, a bottom surface of the side surface portion 613 may be seated on the top surface of the first body 710 on which the fixing protrusion 730 is formed.

Bolt coupling holes 717 and 727 for the coupling of the first bolt S1 and the second bolt S2 may be formed in the first body 710 and the second body 720.

The first bolt S1 may pass through the bolt coupling hole 717 of the first body 710 so as to be coupled to the side panels 102 and 103. The bolt coupling hole 717 of the first body 710 may be disposed between the fixing protrusions 730.

According to the position of the bolt coupling hole 717 of the first body 710, the display case 610 may be more stably seated according to coupling force of the first bolt S1.

The second bolt S2 may pass through the bolt coupling hole 727 of the second body 720 so as to be coupled to the middle plate 150. The bolt coupling hole 727 of the second body 720 may be formed adjacent to the first body 710.

For example, the bolt coupling hole 727 of the second body 720 may be formed at a point at which the first body 710 and the second body 720 are in contact with each other.

Figure 16:
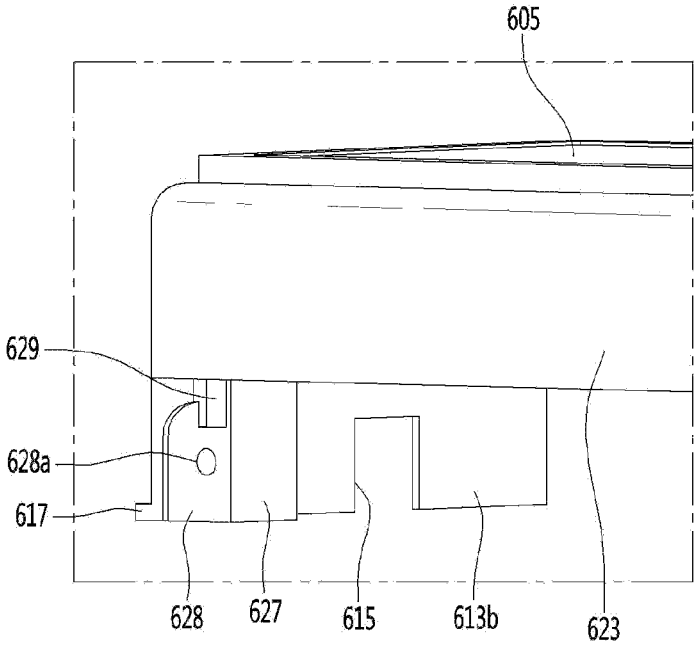
FIG. 16 is an enlarged view illustrating a portion C of FIG. 14.
Figure 17:
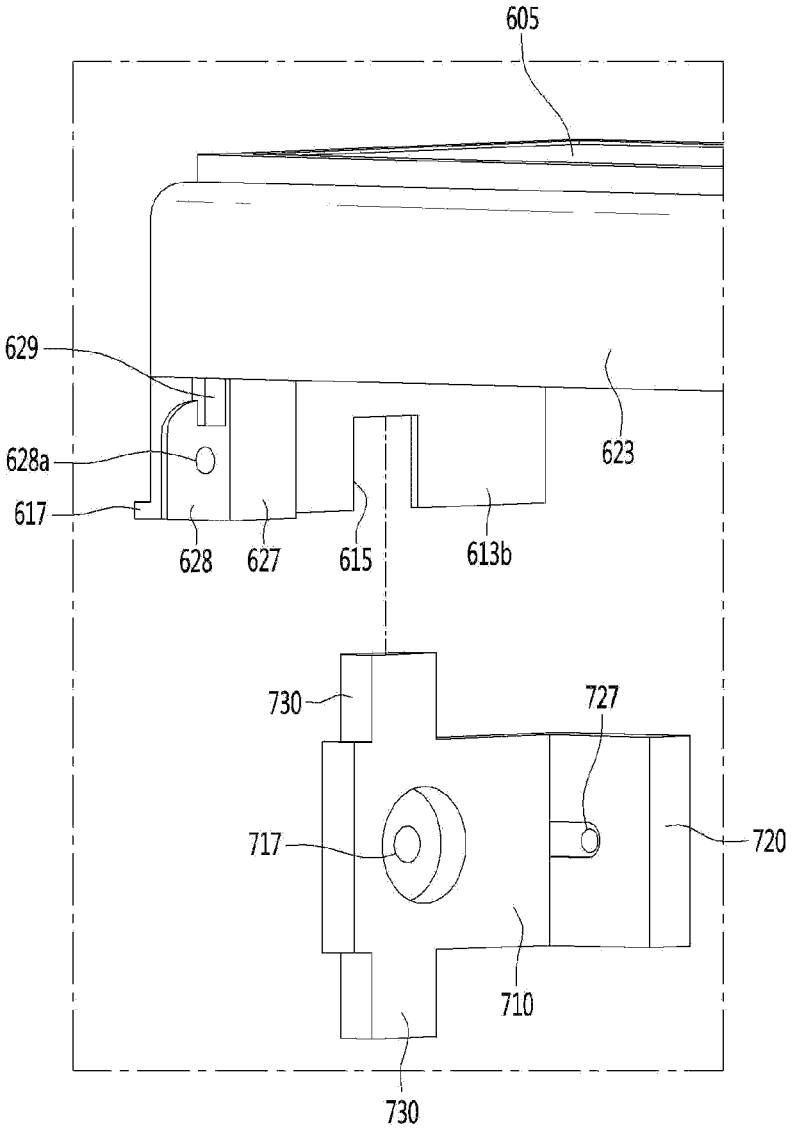
FIG. 17 is a view illustrating a state in which the display unit and the fixing unit are separated from each other according to an embodiment of the present invention.

FIG. 16 is an enlarged view illustrating a portion C of FIG. 14, and FIG. 17 is a view illustrating a state in which the display unit and the fixing unit are separated from each other according to an embodiment of the present invention.

Here, FIG. 16 illustrates a portion B of FIG. 14 in a direction from the support rib 625 to the inner surface 613*a* of the side surface portion 613.

Referring to FIGS. 16 and 17, the protrusion accommodation portion 615 may extend in a vertical direction. In detail, the protrusion accommodation portion 615 may be formed vertically.

In more detail, the protrusion accommodation portion 615 may be formed to be perpendicular to the display panel 605 or the cabinet cover 190.

In addition, the fixing protrusion 730 may be formed vertically to correspond to the protrusion accommodation portion 615. The fixing protrusion 730 may be formed to be perpendicular to a direction in which the first body 710 extends from the second body 720.

Thus, the display case 610 may be assembled in a direction that is perpendicular to the fixing unit 70 and may be separated from the fixing unit 70 in the vertical direction.

Hereinafter, a process of removing the cabinet cover 190 from the refrigerator 1 according to an embodiment of the present invention will be described.

Figure 18:
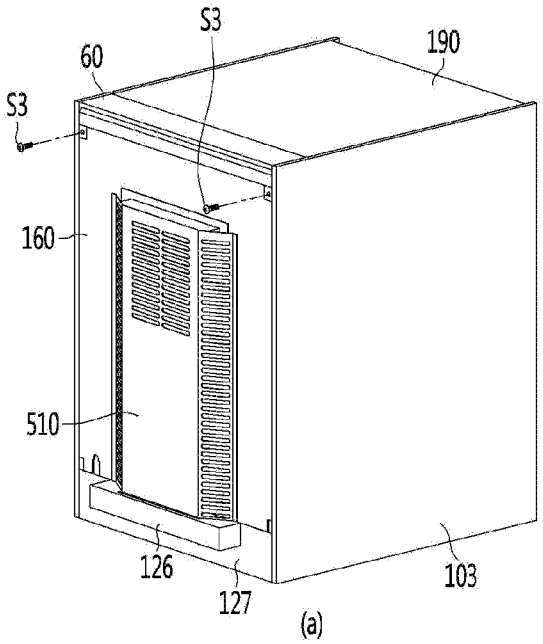
FIG. 18 is a view illustrating a process of separating the display unit from the cabinet according to an embodiment of the present invention.
Figure 18:
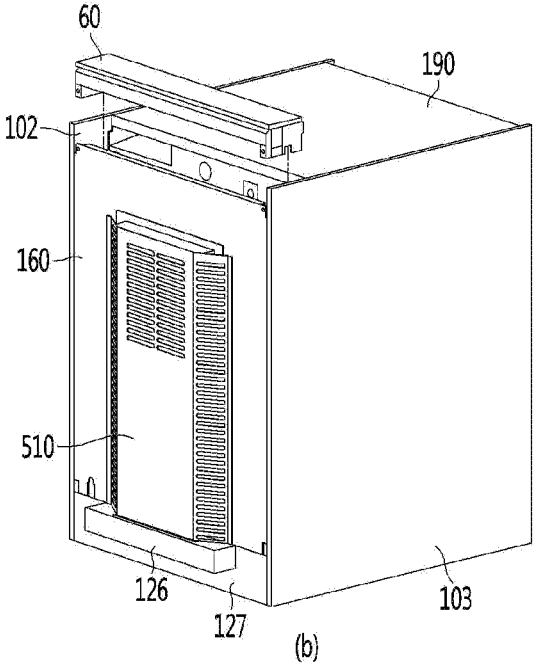
Figure 19:
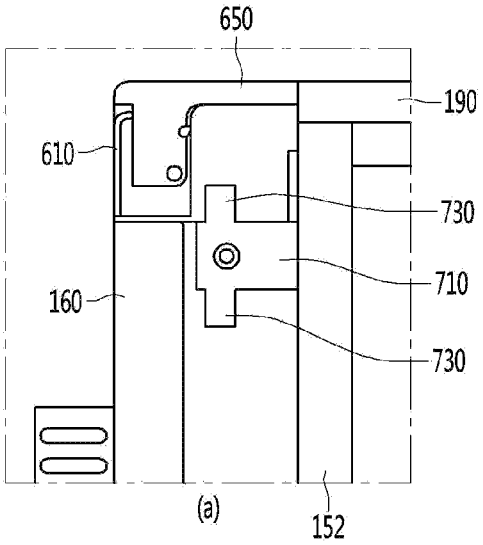
FIG. 19 is a side view illustrating a state in which the display unit is separated.
Figure 19:
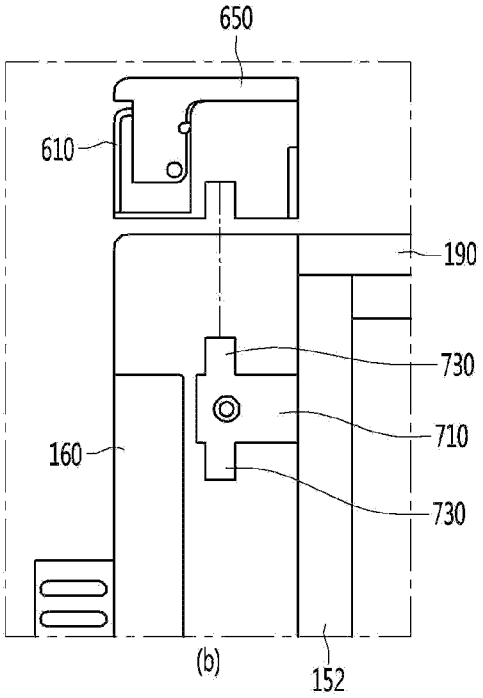
Figure 20:
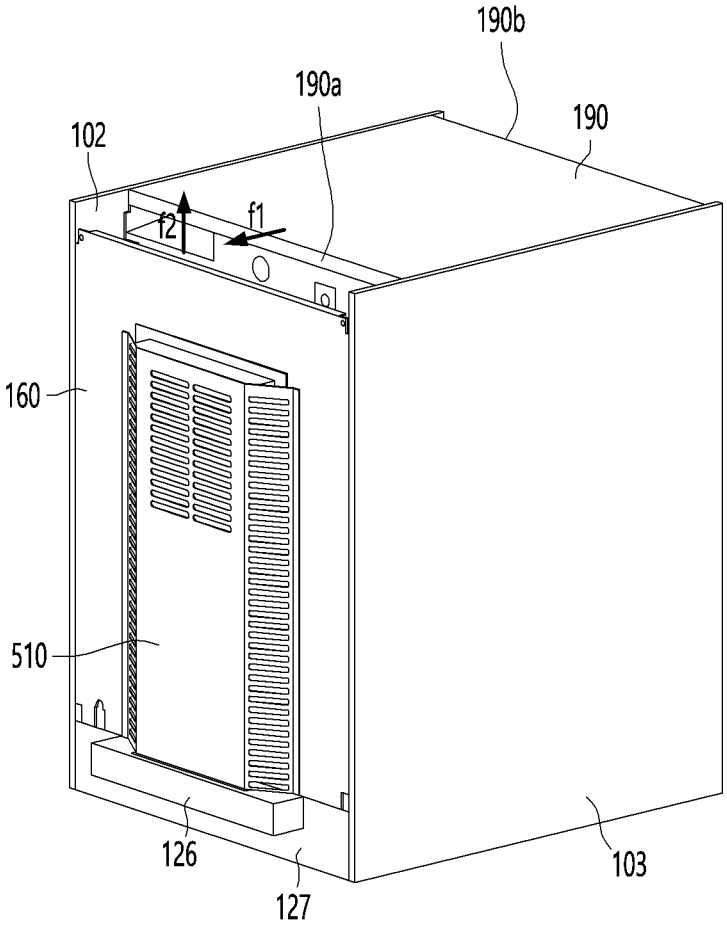
FIG. 20 is a view illustrating a state in which a cabinet cover is separated backward according to an embodiment of the present invention.

FIG. 18 is a view illustrating a process of separating the display unit from the cabinet according to an embodiment of the present invention, FIG. 19 is a side view illustrating a state in which the display unit is separated, and FIG. 20 is a view illustrating a state in which the cabinet cover is separated backward according to an embodiment of the present invention.

Referring to FIGS. 18 to 20, the third bolt S3 coupling the rear panel 160 to the display case 610 may be separated.

Since the third bolt S3 is coupled through the first bolt coupling hole 164 and the second bolt coupling hole 628*a*, when the third bolt S3 is removed, the fixing between the display case 610 and the rear panel 160 may be released.

Even when the third bolt S3 is separated, the rear panel 160 may be disposed between the pair of side panels 102 and 103 by the screw-coupling with the case supporter 130 or the like.

After the third bolt S3 is separated, if the display unit 60 is lifted upward, the display unit 60 may be separated from the fixing unit 70.

Referring to FIG. 19, in the display unit 60, the mounting position may be maintained by inserting the fixing protrusion 730 into the protrusion accommodation portion 615. That is, the upward movement of the display unit 60 may not be limited except for the third bolt S3.

When the separation of the third bolt S3 is completed, the display unit 60 may move upward to release the insertion of the fixing protrusion 730 from the protrusion accommodation portion 615, and thus, the display unit 60 may be removed.

Since there is no coupling structure such as a screw between the display unit 60 and the pair of side panels 102 and 103 or between the display unit 60 and the fixing unit 70, the display unit 60 may be separated from the refrigerator only by lifting the display unit 60 upward.

Therefore, after the third bolt S3 is removed, there is no need to perform the release of the bolt for separating the display unit 60 from the refrigerator 1, and thus, the display unit 60 may be separated simply and quickly.

When the display unit 60 is separated from the refrigerator 1, a space behind the cabinet cover 190 may become empty, and thus, the cabinet cover 190 may move backward.

As illustrated in FIG. 20, the cabinet cover 190 may be detached from the middle plate 150.

For example, the cabinet cover 190 may move backward to separate the cabinet cover 190 from the middle plate 150.

As another example, the cabinet cover 190 may be separated by allow the cabinet cover 190 to move so as to release the coupling with the middle plate 150.

In detail, when the cabinet cover 190 moves rearward (f1), the cover fixing portion 196 of the cabinet cover 190 may be separated from the cover fixing hole 156 of the middle plate 150.

When the cover fixing portion 196 of the cabinet cover 190 is separated from the cover fixing hole 156, the cabinet cover 190 may move (f2) to the refrigerator 1 by allowing the cabinet cover 190 to move upward.

According to the refrigerator 1 according to the embodiment of the present invention, as the service provider releases the third bolt S3, the display unit 60 may move upward, and the backward and upward movements of the cabinet cover 190 may be sequentially performed to separate the cabinet cover 190 from the refrigerator 1 in a short time.

In addition, since the cabinet cover 190 is disassembled by the release of the coupling of the bolt S3, the upward movement of the display unit 60, and the disassembly of the cabinet cover 190, the process of disassembling the cabinet cover 190 may be minimized.

Therefore, even if the cabinet cover 190 is damaged by the user, the process of separating the damaged cabinet cover 190 may be performed very simply and quickly, and thus, efficient service may be possible.

In addition, since the process of replacing the cabinet cover 190 is simple and easy, the user's feeling of discomfort and rejection of the replacement of the cabinet cover 190 may be reduced.

Thus, even if the cabinet cover 190 is not damaged, the user's desire to replace the cabinet cover 190 may increase, and the user's desire to replace the new design cabinet cover 190 may be easily satisfy.

In addition, according to the refrigerator 1 according to the embodiment of the present invention, the display unit 60 may be easily assembled in the refrigerator 1.

In detail, as the display unit 60 is assembled to the upper side of the fixing unit 70, and then, the third bold S3 is coupled, since the mounting of the display unit 60 may be completed, there may be an advantage in that the assembly process is simple.

Similarly, there is an advantage that the display unit 60 may be reassembled in a short time after the cabinet cover 190 is replaced by the simple assembly process of the display unit 60.

That is, since the service process consisted by the separation and reassembly of the display unit 60 and the replacement of the cabinet cover 190 is performed quickly, it may be possible to not only efficiently perform the service but also to increase in user's service satisfaction.

In addition, the display unit 60 may be stably mounted on the refrigerator 1 without moving forward, backward, or upward.

In detail, the fixing protrusion 730 may be mounted in the protrusion accommodation portion 615 to prevent the front and rear movement of the display unit 60, and the third bolt S3 may be coupled to prevent the display unit 60 from moving upward.

The invention claimed is:

1. A refrigerator comprising:

a cabinet having a storage space, and including a pair of side panels configured to define part of an outer appearance;

a cabinet cover disposed between the pair of side panels and configured to define a top surface;

a display unit disposed behind the cabinet cover; and a fixing unit disposed on an inner side of the pair of side panels, and disposed below the display unit to support the display unit, and wherein the fixing unit includes a fixing protrusion that is protruding upwardly when the fixing unit is disposed on the inner side of the side panels, and the display unit includes a protrusion accommodation portion having an opened lower side such that the fixing protrusion is received in the protrusion accommodation portion in response to the display unit being moving downward relative to the fixing unit disposed on the inner side.

2. The refrigerator according to claim 1, wherein the cabinet cover is detached backward in a state of being separated from the display unit.

3. The refrigerator according to claim 1, wherein the fixing unit includes a first body disposed to face one of the side panels, and the fixing protrusion is to protrude from the first body.

4. The refrigerator according to claim 3, further comprising:

an inner case configured to define the storage space; and a middle plate configured to cover part of the inner case, wherein the fixing unit includes a second body that is bent from the first body and the second body is to face the middle plate.

5. The refrigerator according to claim 4, wherein the first body is to couple to one of the side panels, and the second body is to couple to the middle plate.

6. The refrigerator according to claim 4, wherein the middle plate includes a rear plate disposed between the inner case, and the cabinet includes a rear panel that defines a rear surface of the refrigerator, and the second body is to couple to the rear plate.

7. The refrigerator according to claim 3, wherein the fixing protrusion includes a plurality of fixing protrusions, and the plurality of fixing protrusions are to protrude from top and bottom surfaces of the first body.

8. The refrigerator according to claim 1, wherein the cabinet includes:

an inner case configured to define the storage space; and a middle plate configured to cover part of the inner case, the fixing unit includes:

a first body disposed to face one of the side panels; and a second body that is bent from the first body and the second body is to face the middle plate, and the fixing protrusion is to protrude from the first body.

9. The refrigerator according to claim 1, wherein the cabinet includes a rear panel configured to define an outer appearance of a rear surface of the refrigerator, wherein the display unit includes a panel seating portion to be seated on the rear panel.

10. The refrigerator according to claim 9, wherein the panel seating portion includes a bolt coupling hole configured to receive a bolt to restrict vertical movement of the display unit.

11. The refrigerator according to claim 1, wherein the display unit includes:

a display case;

a display panel disposed in the display case; and a display cover configured to cover the display panel, and is rotatably coupled to the display case, wherein the protrusion accommodation portion is disposed on a side surface of the display case to receive the fixing protrusion.

12. The refrigerator according to claim 11, wherein the protrusion accommodation portion is recessed upward from a bottom surface of the side surface of the display case.

13. The refrigerator according to claim 11, wherein a thickness of the fixing protrusion is greater than a thickness of the side surface of the display case.

14. The refrigerator according to claim 11, wherein the fixing protrusion has a same height as the protrusion accommodation portion such that a bottom surface of the side surface of the display case is seated on a top surface of the first body of the fixing unit.

15. The refrigerator according to claim 11, wherein the display case includes a seating groove that is recessed downward from an upper end of the side surface portion of the display case, the display cover includes:

a cover plate configured to cover the display panel; and a pair of extension portions extending downward from ends of the cover plate and are rotatably coupled to the seating groove, and wherein the seating groove is disposed behind the protrusion accommodation portion.

16. The refrigerator according to claim 1, wherein the cabinet includes a rear panel, and the display unit includes a panel seating portion to be seated on the rear panel, wherein the panel seating portion includes a bolt coupling hole to receive a bolt to restrict vertical movement of the display unit.

* * * * *